US008125410B2

(12) United States Patent
Tanaka et al.

(10) Patent No.: US 8,125,410 B2
(45) Date of Patent: Feb. 28, 2012

(54) PLASMA DISPLAY HAVING LATCH FAILURE DETECTING FUNCTION

(75) Inventors: Kazuhito Tanaka, Ohtsu (JP); Akio Niwa, Takatsuki (JP); Mitsuhiro Kasahara, Hirakata (JP); Tadayuki Masumori, Osaka (JP); Mamoru Seike, Takatsuki (JP)

(73) Assignee: Panasonic Corporation, Osaka (JP)

( * ) Notice: Subject to any disclaimer, the term of this patent is extended or adjusted under 35 U.S.C. 154(b) by 1107 days.

(21) Appl. No.: 10/567,357

(22) PCT Filed: Aug. 4, 2004

(86) PCT No.: PCT/JP2004/011504

§ 371 (c)(1),
(2), (4) Date: Feb. 6, 2006

(87) PCT Pub. No.: WO2005/015528

PCT Pub. Date: Feb. 17, 2005

(65) Prior Publication Data

US 2006/0220992 A1 Oct. 5, 2006

(30) Foreign Application Priority Data

Aug. 7, 2003 (JP) ..... 2003-289012
May 26, 2004 (JP) ..... 2004-156409

(51) Int. Cl.
*G09G 3/28* (2006.01)

(52) U.S. Cl. ..... 345/60

(58) Field of Classification Search ..... 345/32, 345/60–72, 213, 904, 204, 99; 348/175–194; 324/770; 327/158
See application file for complete search history.

(56) References Cited

U.S. PATENT DOCUMENTS 4,697,107 A * 9/1987 Haines ..... 326/60
4,893,319 A 1/1990 Ziuchkovski
5,451,894 A 9/1995 Guo
5,793,363 A * 8/1998 Takuwa ..... 345/205
6,097,444 A * 8/2000 Nakano ..... 348/607
6,100,721 A * 8/2000 Durec et al. ..... 327/3
6,288,699 B1 * 9/2001 Kubota et al. ..... 345/99
6,462,721 B2 10/2002 Kasahara et al.
6,501,309 B1 12/2002 Tomita
6,559,603 B2 * 5/2003 Iwami ..... 315/169.1

(Continued)

FOREIGN PATENT DOCUMENTS

EP 0613245 8/1994

(Continued)

OTHER PUBLICATIONS

English Language Abstract of JP 2002-156941.

(Continued)

*Primary Examiner* — Amr Awad
*Assistant Examiner* — Dennis Joseph
(74) *Attorney, Agent, or Firm* — Greenblum & Bernstein, P.L.C.

(57) ABSTRACT

A test pattern generation circuit outputs a test pattern during a clock phase adjustment period. A flip-flop circuit latches the test pattern at the fall of a shift clock and outputs it as a test pattern. A latch miss detection circuit outputs a latch miss detection signal indicating presence/absence of a latch miss generation according to the test pattern and a delay shift clock. A clock phase controller delays the shift clock according to the latch miss detection signal, thereby outputting a delay shift clock.

19 Claims, 22 Drawing Sheets

U.S. PATENT DOCUMENTS

| | | | | |
|---|---|---|---|---|
| 6,690,388 | B2 | 2/2004 | Kasahara et al. | |
| 6,924,796 | B1 * | 8/2005 | Someya et al. | 345/213 |
| 6,927,751 | B2 | 8/2005 | Ide et al. | |
| 2001/0054924 | A1 * | 12/2001 | Saito | 327/276 |
| 2001/0055009 | A1 | 12/2001 | Zhang et al. | |
| 2002/0109650 | A1 * | 8/2002 | Kougami et al. | 345/60 |
| 2002/0180668 | A1 | 12/2002 | Ide et al. | |
| 2002/0196225 | A1 | 12/2002 | Fukuda et al. | |
| 2003/0122812 | A1 * | 7/2003 | Onozawa et al. | 345/211 |
| 2004/0012580 | A1 * | 1/2004 | Yamagishi et al. | 345/204 |
| 2006/0038750 | A1 | 2/2006 | Inoue et al. | |

FOREIGN PATENT DOCUMENTS

| | | | |
|---|---|---|---|
| EP | 613245 | A1 * | 8/1994 |
| JP | 2-271794 | A | 11/1990 |
| JP | 6-152567 | | 5/1994 |
| JP | 6-167946 | | 6/1994 |
| JP | 6-167946 | A | 6/1994 |
| JP | 10-232655 | | 9/1998 |
| JP | 10-232655 | A | 9/1998 |
| JP | 10-260653 | | 9/1998 |
| JP | 2000-035777 | A | 2/2000 |
| JP | 2001-051653 | A | 2/2001 |
| JP | 2002-006790 | A | 1/2002 |
| JP | 2002-156941 | | 5/2002 |
| JP | 2002-358044 | | 12/2002 |
| JP | 2003-005703 | A | 1/2003 |
| JP | 2003-058102 | A | 2/2003 |

OTHER PUBLICATIONS

English Language Abstract of JP 2002-358044.
English Language Abstract of Jp 10-260653.
English Language Abstract of JP 10-232655.
English Language Abstract of JP 6-152567.
English Language Abstract of JP 6-167946.
English language Abstract of JP 2003-058102 A, Feb. 28, 2003.
English language Abstract of JP 2002-006790 A, Jan. 11, 2002.
English language Abstract of JP 2-271794 A, Nov. 6, 1990.
English language Abstract of JP 6-167946 A, Jun. 14, 1994.
English language Abstract of JP 10-232655 A. Sep. 2, 1998.
English language Abstract of JP 2000-035777 A, Feb. 2, 2000.
English language Abstract of JP 2001-051653 A, Feb. 23, 2001.
English language Abstract of JP 2003-005703 A, Jan. 8, 2003.

* cited by examiner

P1<THRESHOLD X
P2<THRESHOLD X
P3>THRESHOLD X ⇒ OPTIMAL PHASE DELAY AMOUNT $= \frac{d5+d6}{2}$

PLASMA DISPLAY HAVING LATCH FAILURE DETECTING FUNCTION

TECHNICAL FIELD

The present invention relates to a display device having a data driver that drives a plurality of electrodes based on serial data.

BACKGROUND ART

A plasma display device using a PDP (plasma display panel) has an advantage of enabling reduction in thickness and realization of a large screen, whose development has been advanced (refer to JP 2002-156941 A, for example).

In the PDP, a plurality of data electrodes are arranged in a vertical direction, a plurality of pairs of scan electrode and sustain electrode are arranged in a horizontal direction, and discharge cells are formed at intersections thereof. The plurality of data electrodes are driven by a data driver.

Serial data obtained based on a video signal is provided to the data driver. The data driver includes a plurality of latch circuits (flip-flop circuits) and a shift register. The serial data provided to the data driver is stored in the shift register while being latched in the latch circuits in response to a shift clock (clock signal). Thereafter, the serial data stored in the shift register is converted into parallel data. Based on the parallel data, drive pulses are applied to the plurality of data electrodes.

However, if a distance between the positions in which the serial data and the shift clock are generated and the position of the data driver is large, a length of a transmission line that transmits those serial data and the shift clock is large. Thus, the phases of the serial data and the shift clock may be changed, thereby causing a latch failure in the data driver.

The latch failure means that a value of a data string outputted from a latch circuit is different from a value of a data string inputted into the latch circuit by deviation of the phase of the data string inputted into the latch circuit or the phase of the clock signal from a normal phase.

DISCLOSURE OF INVENTION

An object of the present invention is to provide a display device in which a latch failure is prevented from occurring in a data driver.

A display device according to one aspect of the present invention comprises a plurality of discharge cells, a clock signal generator that generates a clock signal, a serial data generator that generates serial data according to an image to be displayed, a test signal generator that generates a test signal, a data driver that selectively applies a drive pulse to the plurality of discharge cells based on the serial data generated by the serial data generator in synchronization with the clock signal in a write period for selecting the discharge cell to be lighted, a latch failure detector that detects the presence/absence of a latch failure in the data driver based on the test signal generated by the test signal generator in a period other than the write period, and a phase adjusting device that when the latch failure is detected by the latch failure detector, adjusts the phase of the clock signal provided from the clock signal generator to the data driver based on the phase of the clock signal in which the latch failure is detected.

In the display device, in the write period for selecting the discharge cell to be lighted, the drive pulse is selectively applied to the plurality of discharge cells by the data driver based on the serial data generated by the serial data generator in synchronization with the clock signal generated by the clock signal generator.

Furthermore, in the period other than the write period, the presence/absence of the latch failure in the data driver is detected by the latch failure detector based on the test signal generated by the test signal generator. When the latch failure is detected by the latch failure detector, the phase of the clock signal provided from the clock signal generator to the data driver is adjusted to the phase in which no latch failure occurs in the data driver by the phase adjusting device.

Accordingly, the latch failure in the data driver can be prevented. Furthermore, even if phase fluctuations of the clock signal and the serial data due to temperature characteristics and individual variation occur, the latch failure can be prevented from occurring. Furthermore, a distance between the positions in which the clock signal and serial data are generated and the position of the data driver can be made large. Furthermore, transmission frequencies of the clock signal and the serial data can be improved.

The data driver may include a plurality of data driver units, and the latch failure detector may include a plurality of latch failure detecting circuits that detect the presence/absence of the latch failure by the respective data driver units based on the test signal outputted from the test signal generator, and when the latch failure is detected in at least one of the plurality of latch failure detecting circuits, the phase adjusting device may adjust the phase of the clock signal provided to the plurality of data driver units from the clock signal generator.

In this case, by the plurality of latch failure detecting circuits, the presence/absence of the latch failure by the data driver units is detected based on the test signal outputted from the test signal generator. When the latch failure is detected in at least one of the latch failure detecting circuits, the phase of the clock signal provided to the plurality of data driver units from the clock signal generator is adjusted by the phase adjusting device.

Thus, the one phase adjusting device enables the clock phase adjustment for the plurality of data driver units. Accordingly, the circuit configuration is simplified.

The plurality of latch failure detecting circuit may each have an open drain output; and the phase adjusting device may receive the open drain outputs of the plurality of latch failure detecting circuits via wired-OR connection.

In this case, the open drain outputs of the plurality of latch failure detecting circuits are provided to the phase adjusting device via the wired-OR connection. This simplifies the circuit configuration.

The test signal may be an alternating pulse signal that is inverted every period of the clock signal. In this case, the incidence of the latch failure in the test signal in the data driver is improved. Thus, the clock signal can be adjusted to an optimal phase with a high accuracy. Furthermore, time required for adjusting the clock signal to the optimal phase is shortened.

The phase adjusting device may adjust the phase of the clock signal at predetermined intervals. In this case, since the clock signal is constantly adjusted to the optimal phase, the latch failure is prevented in the data driver when the serial data is latched in the write period.

The phase adjusting device may adjust the phase of the clock signal at intervals of a plurality of fields. In this case, the interval at which the phase adjustment of the clock signal is performed is made larger. This reduces power consumption required for the phase adjustment.

The adjustment period may include a plurality of adjustment periods, and when the adjustment of the clock signal has not finished in one adjustment period, the phase adjusting device may continue the phase adjustment of the clock signal from the beginning of the next adjustment period. In this case, time required for completing the phase adjustment of the clock signal can be shortened.

The latch failure detector may generate a latch failure detection signal indicating the presence/absence of the latch failure, based on an exclusive logical sum of a first test signal obtained by delaying the test signal by one period of the clock and a second test signal obtained by delaying the test signal by two periods of the clock.

In this case, when the phase of the clock signal is not the optimal phase, the latch failure is surely detected. Thus, the clock signal can be adjusted to the optimal phase with a high accuracy. Furthermore, time required for adjusting the clock signal to the optimal phase is shortened.

The latch failure detector may generate a plurality of latch failure detection signals obtained by sequentially delaying the latch failure detection signal by a predetermined delay amount to generate a logical product of the plurality of latch failure detection signals.

In this case, a detection width of the latch failure is made larger, so that the latch failure is surely detected. Thus, the clock signal can be adjusted to the optimal phase with a high accuracy. Furthermore, the time for adjusting the clock signal to the optimal phase is shortened.

The latch failure detector may include a holding circuit that holds a detection result of the latch failure until a reset signal is inputted. In this case, the detection width of the latch failure is made larger up to the input of the reset signal. Thus, the clock signal can be adjusted to the optimal phase with a high accuracy. Furthermore, the time for adjusting the clock signal to the optimal phase is shortened.

The latch failure detector may further include a reset signal generating circuit that generates the reset signal based on the detection result of the latch failure.

In this case, no dedicated reset signal needs to be outputted to the latch failure detector. This can simplify the connection between circuits.

The reset signal generating circuit may include a delay circuit that delays the detection result of the latch failure. In this case, the reset signal can be generated with a simple configuration.

The phase adjusting device may include a ring buffer including a plurality of delay elements that sequentially delay the clock signal by a predetermined delay amount, and a selector that selectively outputs a plurality of clock signals outputted from the plurality of delay elements of the ring buffer.

In this case, the clock signal selected among the plurality of clock signals sequentially delayed by the predetermined delay amount is outputted from the selector. Thus, the phase adjustment of the clock signal with a high accuracy can be performed. Furthermore, since the clock signals are sequentially delayed by the predetermined delay amount by the ring buffer, fluctuations in the delay amount due to temperature changes are suppressed.

The phase adjusting device may include a plurality of delay circuits each having a different number of delay amounts, and a connecting circuit that selects one or more of the plurality of delay circuits so as to constitute a series-connecting circuit by the selected one or more of the plurality of delay circuits and provides the clock signal to the series-connecting circuit.

In this case, one of more of the plurality of delay circuits each having a different delay amount may be connected by the connectors and the phase of the clock signal is sequentially delayed by the predetermined delay amount. Thus, the phase adjustment of the clock signal with a high accuracy can be performed.

The phase adjusting device may finish the adjustment of the phase of the clock signal by the time the clock signal is delayed by two periods. In this case, unnecessary phase adjustment is reduced, so that the time required for the phase adjustment is reduced, and the power consumption required for the phase adjustment is reduced.

The phase adjusting device may be operable to detect that the phase of the adjusted clock signal is the optimal phase and may finish the adjustment of the phase of the clock signal when it is detected that the phase of the clock signal is the optimal phase.

In this case, the optimal phase of the clock signal is detected and at the same time, the adjustment of the phase of the clock signal is finished. Thus, the power consumption required for the phase adjustment of the clock signal is reduced.

The display device may further comprise a first storage device that stores the phase of the clock signal adjusted by the phase adjusting device as the optimal phase, and the phase adjusting device may adjust the phase of the clock signal to the optimal phase stored in the first storage device in the write period after the optimal phase is stored by the first storage device.

In this case, the serial data is latched in the data driver in synchronization with the clock signal adjusted to the optimal phase stored by the first storage device in the write period. This prevents the latch failure in the data driver when the serial data is latched in the write period.

The phase adjusting device may adjust the phase of the clock signal to the phase stored in advance in the first storage device when the adjustment of the clock signal has not finished in the adjustment period.

In this case, even if the phase adjustment of the clock signal has not finished within the adjustment period, the phase of the clock signal is adjusted to the phase stored in the first storage device in the previous adjustment.

Thus, even if the phase of the clock signal has not been adjusted, the serial data is latched in the data driver, so that the data driver operates.

The phase adjusting device may vary the phase of the clock signal to detect a range of phase where no latch failure occurs and when the detected range is larger than a predetermined threshold, may store, in the first storage device, a phase in the center of the detected range of phase as the optimal phase.

In this case, the width of phase in which no latch failure occurs is larger than the threshold, so that the optimal phase of the clock signal is surely detected.

The phase adjusting device may adjust the relative phase of the clock signal with respect to the serial data so that the adjusted clock signal is outputted to the data driver just as a start portion of the serial data is outputted to the data driver.

In this case, the series data is latched from the start portion of the serial data in the data driver in synchronization with the clock signal. Accordingly, all the serial data transferred to the data driver is surely latched.

The phase adjusting device may adjust the phase of the serial data so that the phase of a start portion of the serial data outputted to the data driver and the phase of a start portion of the clock signal outputted to the data driver substantially coincide with each other when it is detected that the phase of the clock signal is the optimal phase.

When it is detected that the phase of the clock signal is the optimal phase, the latch failure does not occur, and thus the phase of the serial data can be adjusted with a high accuracy.

The display device may further comprises a second storage device that stores the phase of the serial data adjusted by the phase adjusting device as an optimal phase, and the phase adjusting device may adjust the phase of the serial data to the optimal phase stored in the second storage device in the write period after the optimal phase is detected by the second storage device.

In this case, in the write period, the serial data adjusted to the optimal phase stored by the second storage device is latched in the data driver. Thus, the serial data with the optimal phase is transferred to the data driver in synchronization with the clock signal with the optimal phase. Accordingly, the serial data can be stably transferred to the data driver.

The phase adjusting device may adjust the phase of the clock signal to the optimal phase stored in the first storage device last time and may adjust the phase of the serial data to the optimal phase stored in the second storage device last time when the optimal phase of the clock signal or the optimal phase of the serial data is not detected.

In this case, even if the optimal phase of the clock signal or the optimal phase of the serial data is not detected due to noise or the like, the phase of the clock signal is adjusted to the optimal phase stored in the first storage device last time and the phase of the serial data is adjusted to the optimal phase stored in the second storage device last time. This ensures stable writing operation of the serial data to the data driver.

The adjustment period may be set to a sustain period during which light emitting of the discharge cell selected in the write period is sustained. In this case, the phase adjustment of the clock signal is performed in a period other than the period when the serial data is transferred to the data driver. Thus, the transfer of the serial data to the data driver is not affected.

The latch failure in the data driver can be prevented. Furthermore, even if phase fluctuations of the clock signal and the serial data due to temperature characteristics or individual variation occur, the occurrence of the latch failure is prevented. Moreover, the distance between the positions in which the clock signal and serial data are generated and the position of the data driver can be made large. Still further, the transmission frequency of the clock signal and the serial data can be improved.

BEST MODE FOR CARRYING OUT THE INVENTION

First Embodiment

Hereinafter, a plasma display device is described as one example of a display device according to the present invention.

Figure 1:
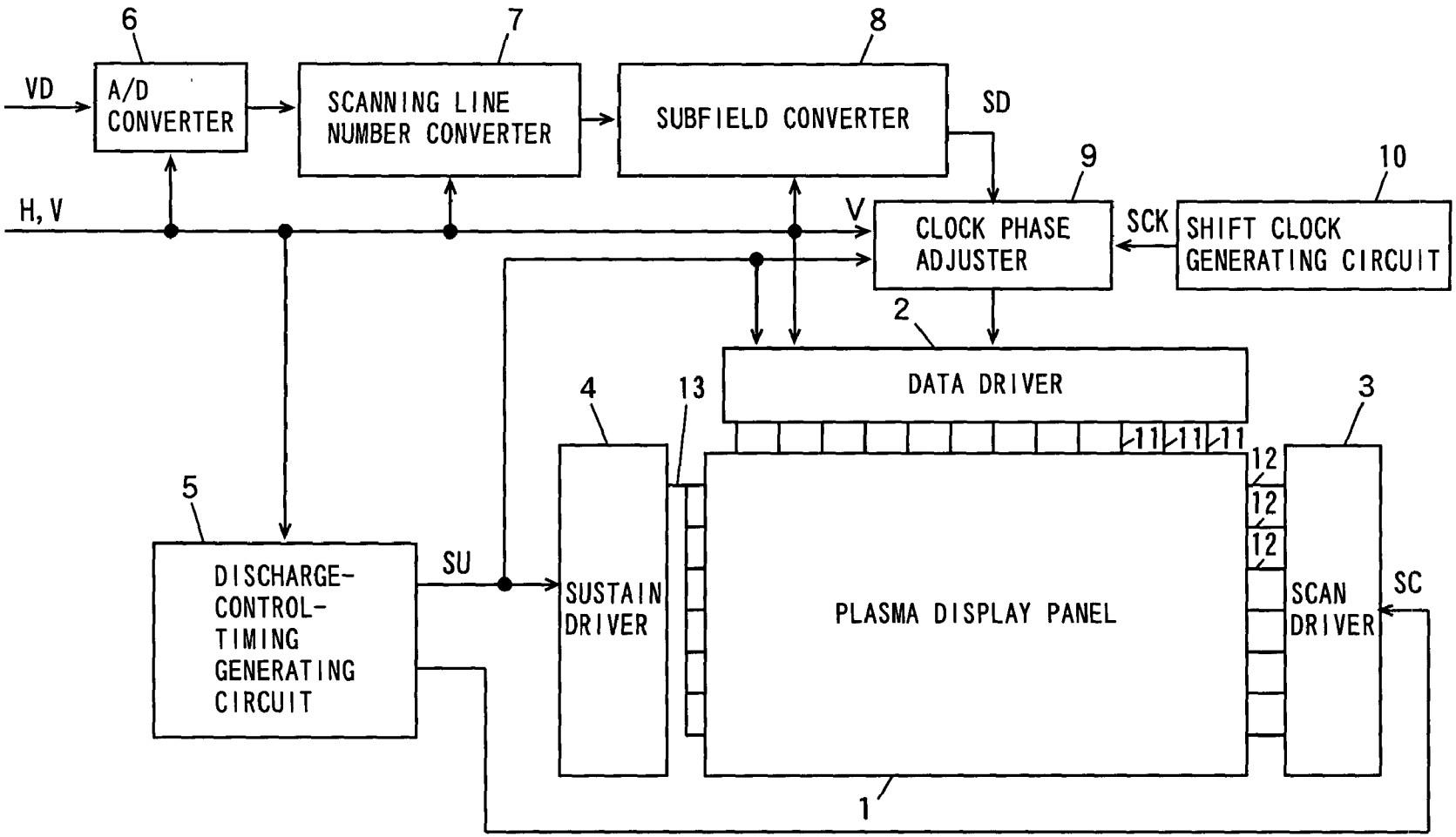
FIG. 1 is a block diagram showing a configuration of a plasma display device according to one embodiment of the present invention.

FIG. 1 is a block diagram showing a configuration of a plasma display device according to one embodiment of the present invention.

The plasma display device of FIG. 1 includes a PDP (plasma display panel) 1, a data driver 2, a scan driver 3, a sustain driver 4, a discharge-control-timing generating circuit 5, an A/D converter (analog/digital converter) 6, a scanning line number converter 7, a subfield converter 8, and a clock phase adjuster 9 and a shift clock generating circuit 10.

A video signal VD is inputted into the A/D converter 6. A horizontal synchronizing signal H and a vertical synchronizing signal V are provided to the discharge-control-timing generating circuit 5, A/D converter 6, scanning line number converter 7, subfield converter 8 and data driver 2. Furthermore, the vertical synchronizing signal V is provided to the clock phase adjuster 9. A shift clock SCK is provided from the shift clock generating circuit 10 to the clock phase adjuster 9.

The A/D converter 6 converts the video signal VD to digital image data and provides the image data to the scanning line number converter 7. The scanning line number converter 7 converts the image data to image data with the number of lines corresponding to the number of pixels of the PDP 1 and provides the image data of each line to the subfield converter 8. The image data of each line includes of a plurality of pieces of pixel data corresponding to a plurality of pixels of each line, respectively.

The subfield converter 8 converts each pixel data of the image data of each line to serial data SD corresponding to a plurality of subfields and provides the serial data SD to the clock phase adjuster 9 in every subfield. The clock phase adjuster 9 adjusts the shift clock SCK to an optimal phase and provides the same to the data driver 2 together with the serial data SD.

The discharge-control-timing generating circuit 5 generates discharge control timing signals SC, SU based on the horizontal synchronizing signal H and the vertical synchronizing signal V. The discharge-control-timing generating circuit 5 provides the discharge control timing signal SC to the scan driver 3 and the discharge control timing signal SU to the sustain driver 4, the data driver 2 and the clock phase adjuster 9.

The PDP 1 includes a plurality of data electrodes 11, a plurality of scan electrodes 12 and a plurality of sustain electrodes 13. The plurality of data electrodes 11 are arranged in a vertical direction of a screen, the plurality of scan electrodes 12 and the plurality of sustain electrodes 13 are arranged in a horizontal direction of the screen. The plurality of sustain electrodes 13 are connected in common.

Discharge cells are formed at respective intersections of the data electrodes 11, the scan electrodes 12 and the sustain electrodes 13, and the respective discharge cells makeup pixels on the screen.

The data driver 2 converts the serial data SD provided from the clock phase adjuster 9 to parallel data, and a writing pulse is selectively provided to the plurality of data electrodes 11 based on the parallel data.

The scan driver 3 drives the respective scan electrodes 12 based on the discharge control timing signal SC provided from the discharge-control-timing generating circuit 5. The sustain driver 4 drives the sustain electrodes 13 based on the discharge control timing signal SU provided from the discharge-control-timing generating circuit 5.

In the plasma display device as shown in FIG. 1, an ADS (Address Display-Period Separation) method is used.

Figure 2:
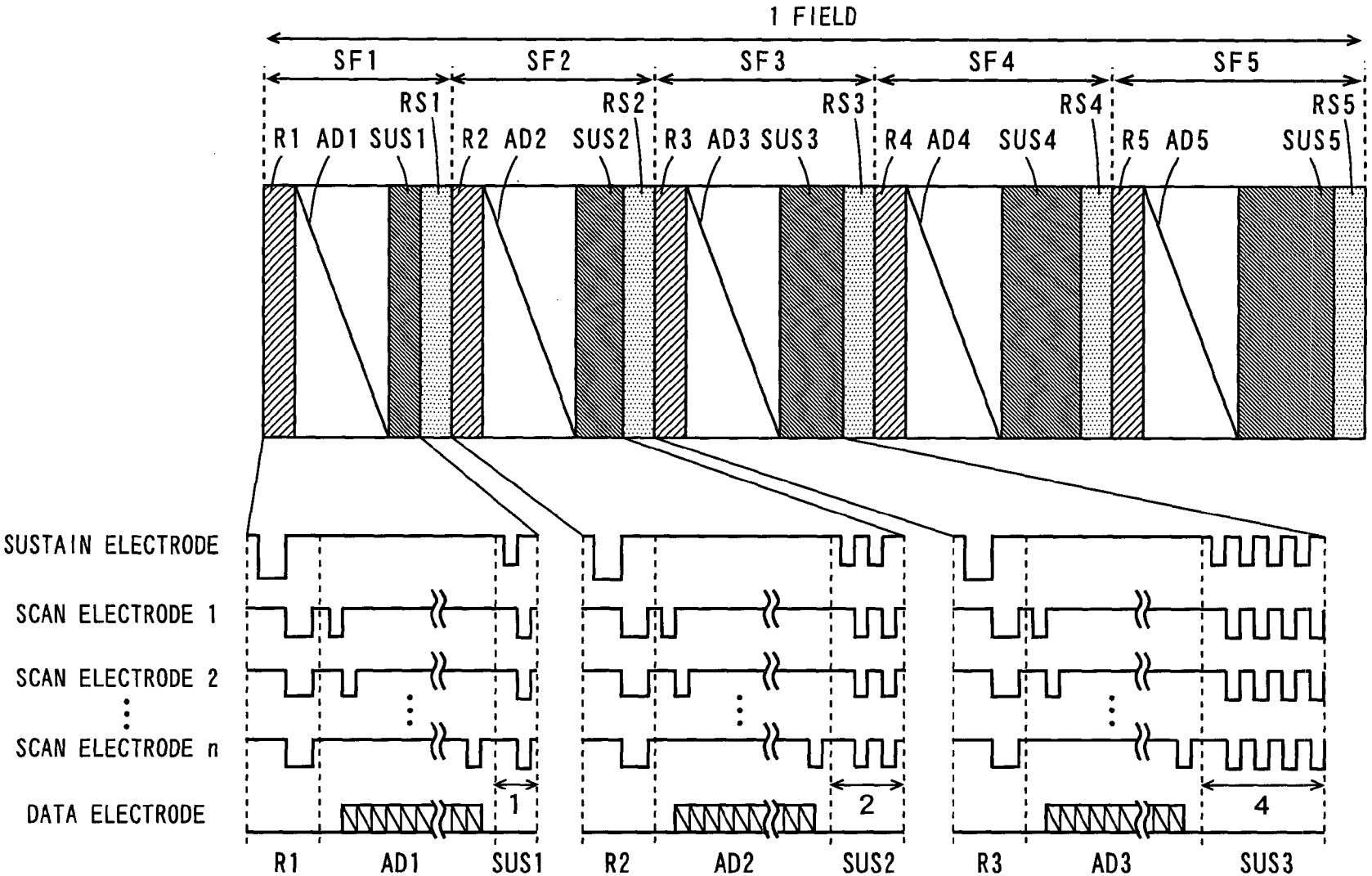
FIG. 2 is a diagram for explaining an ADS method applied to the plasma display device shown in FIG. 1.

FIG. 2 is a diagram for explaining the ADS method applied to the plasma display device shown in FIG. 1. While in FIG. 2, an example of a negative-polarity pulse in which discharge is performed at the fall of the drive pulse is shown, a basic operation is similar to that described below in the case of a positive-polarity pulse in which discharge is performed at the rise.

In the ADS method, one field is temporally divided into a plurality of subfields. For example, one field is divided into five subfields of SF1 to SF5. The respective subfields SF1 to SF5 are separated into initialization periods R1 to R5, write periods AD1 to AD5, sustain periods SUS1 to SUS5, and erase periods RS1 to RS5. In the initialization periods R1 to R5, initialization processing of the respective subfields is performed, in the write periods AD1 to AD5, address discharge is performed for selecting a discharge cell or cells to be lighted, and in the sustain periods SUS1 to SUS5, the sustain discharge for display is performed.

In the initialization periods R1 to R5, a single initialization pulse is applied to the sustain electrodes 13 and a single initialization pulse is applied to the scan electrodes 12, respectively. This allows preliminary discharge to be performed.

In the write periods AD1 to AD5, the scan electrodes 12 are sequentially scanned and predetermined writing processing is performed only in the discharge cell or cells which have received a writing pulse from the data electrodes 11. This allows the address discharge to be performed.

In the sustain periods SUS1 to SUS5, sustain pulses according to a value weighed to each of the subfields SF1 to SF5 are outputted to the sustain electrodes 13 and the scan electrodes 12. For example, in the subfield SF1, the sustain pulse is applied to the sustain electrodes 13 once, the sustain pulse is applied to the scan electrodes 12 once, so that the discharge cell or cells 14 selected in the write period AD1 perform the sustain discharge twice. Furthermore, in the subfield SF2, the sustain pulse is applied to the sustain electrodes 13 twice, the sustain pulse is applied to the scan electrodes 12 twice, so that the discharge cell or cells 14 selected in the write period AD2 perform the sustain discharge four times.

As described above, in the respective subfields SF1 to SF5, the sustain pulses are applied to the sustain electrodes 13 and the scan electrodes 12, once, twice, 4 times, 8 times and 16 times, respectively, so that the discharge cell or cells emit light at brightness (luminance) according to the number of pulses. Namely, the sustain periods SUS1 to SUS5 are periods when the discharge cells selected in the write periods AD1 to AD5 discharge at the number of times according to the weighed amount of brightness. Furthermore, in the sustain periods SUS 1 to SUS5, the phase of shift clock SCK provided to the clock phase adjuster 9 of FIG. 1 is adjusted. The adjustment of the phase of the shift clock SCK will be described later in detail.

Figure 3:
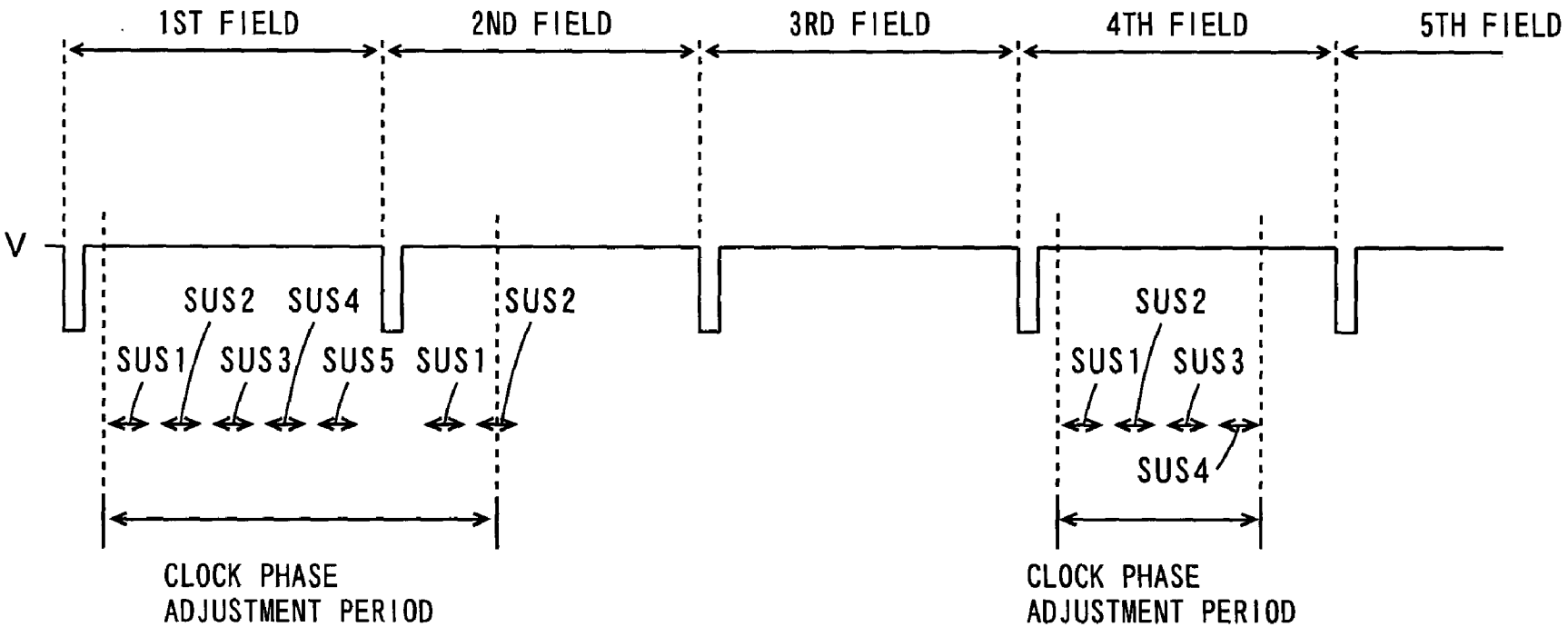
FIG. 3 is a diagram for explaining a period when the phase of a shift clock provided to a clock phase adjuster shown in FIG. 1 is adjusted.

FIG. 3 is a diagram for explaining a period when the phase of the shift clock SCK provided to the clock phase adjuster 9 of FIG. 1 is adjusted (hereinafter, referred to as clock phase adjustment period). The axis of abscissas of FIG. 3 indicates time. In FIG. 3, the vertical synchronizing signal V and the clock phase adjustment period are shown.

As shown in FIG. 3, the clock phase adjustment period starts at the beginning of the sustain period SUS1 of a first field to perform the phase adjustment of the shift clock SCK. If the phase adjustment has not finished within the sustain period SUS1, the phase adjustment of the shift clock SCK is continued from the beginning of the next sustain period SUS2. Similarly, the phase adjustment of the shift clock SCK is performed in the sustain periods SUS3, SUS4 and SUS5 until the phase adjustment of the shift clock SCK is finished.

If the phase adjustment of the shift clock SCK has not finished within the first field, the phase adjustment of the shift clock SCK is continued from the beginning of the sustain period SUS1 of a second field. When the phase adjustment of the shift clock SCK is finished, the clock phase adjustment period is finished.

In the plasma display device according to the present embodiment, the phase adjustment of the shift clock SCK is performed every three fields. Accordingly, the next clock phase adjustment period starts at the beginning of the sustain period SUS1 of a fourth field.

Similarly, the clock phase adjustment period starts at the beginning of the sustain period SUS1 every three fields.

The phase adjustment period of the shift clock SCK is not limited to every three fields, but can be set to every arbitrary number of fields.

From the foregoing, even if phase fluctuations in the shift clock SCK and the serial data SD occur due to temperature characteristics and individual variation of the plasma display device, the latch failure can be prevented from occurring. Furthermore, the distance between the positions in which the shift clock SCK and serial data SD are generated and the position of the data driver can be made large. Moreover, transmission frequencies of the shift clock SCK and the serial data can be improved.

Figure 4:
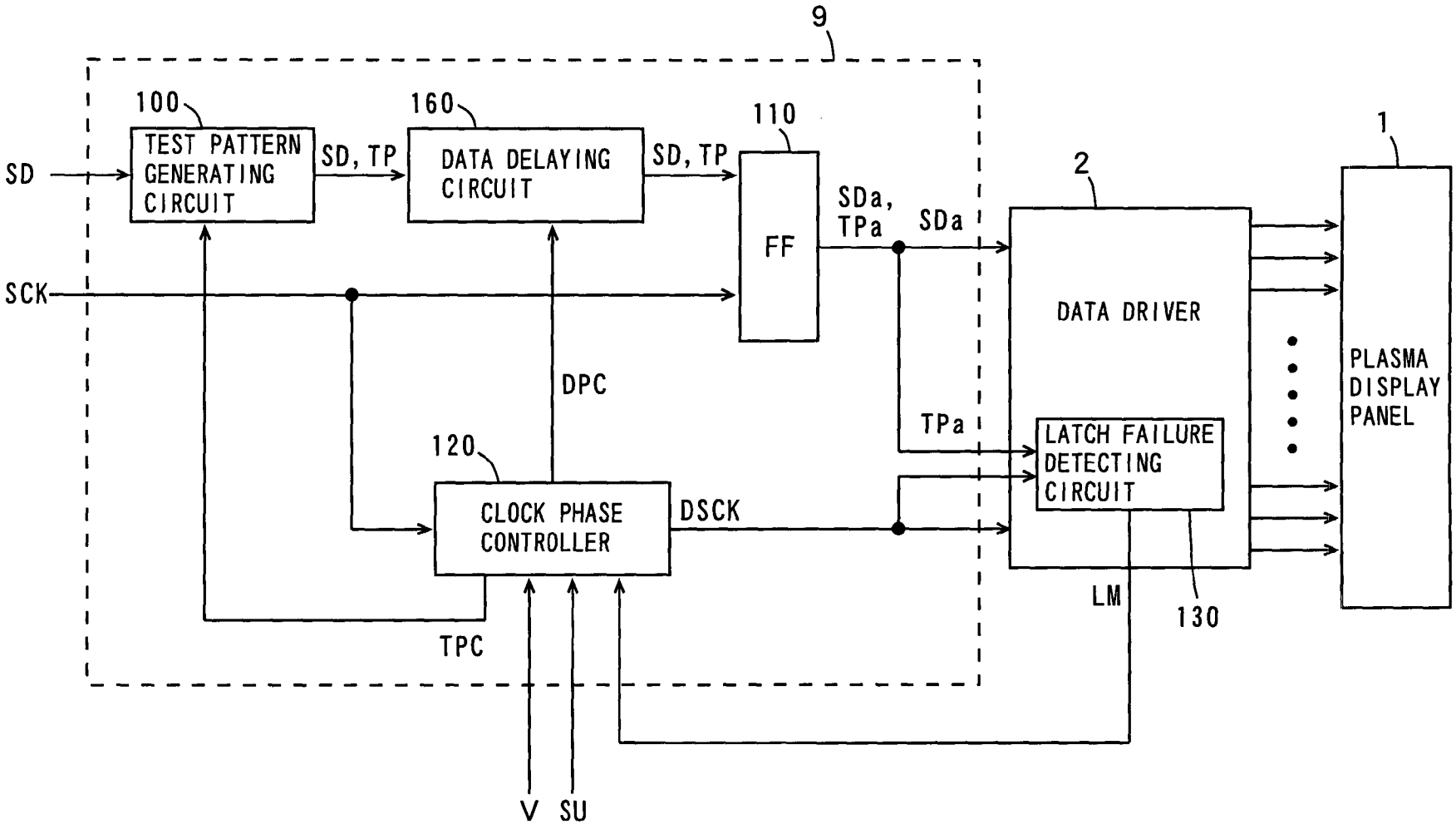
FIG. 4 is a block diagram showing an internal configuration of the clock phase adjuster shown in FIG. 1.

FIG. 4 is a block diagram showing a configuration of the clock phase adjuster 9 and the data driver 2 of FIG. 1

As shown in FIG. 4, the clock phase adjuster 9 includes a test pattern generating circuit 100, a flip-flop circuit 110, a clock phase controller 120, and a data delay circuit 160. The data driver 2 includes a latch failure detecting circuit 130.

The serial data SD outputted by the subfield converter 8 of FIG. 1 and a test pattern control signal TPC outputted by the clock phase controller 120 are provided to the test pattern generating circuit 100.

The test pattern generating circuit 100 outputs the serial data SD provided from the subfield converter 8 without modification in the write periods AD1 to AD5 described in FIG. 2. Furthermore, the test pattern generating circuit 100 outputs a test pattern TP according to the test pattern control signal TPC provided from the clock phase controller 120, which will be described later, in the clock phase adjustment period described in FIG. 3.

The serial data SD or the test pattern TP outputted by the test pattern generating circuit 100 is provided to the data delay circuit 160. The data delay circuit 160 outputs the test pattern TP without modification, and delays the serial data SD based on a phase delay signal DPC provided from the clock phase controller 120, which will be described later, to output the same. The operation of the data delay circuit 160 will be described later.

The serial data SD or the test pattern TP outputted from the data delay circuit 160 is provided to the flip-flop circuit 110 and at the same time, the shift clock SCK from the shift clock generating circuit 10 of FIG. 1 is provided. The flip-flop circuit 110 latches the serial data SD or the test pattern TP at the fall of the shift clock SCK and outputs the result as serial data SDa or a test pattern TPa.

The test pattern TPa outputted by the flip-flop circuit 110 and a delay shift clock DSCK outputted by the clock phase controller 120, which will be described later, are provided to the latch failure detecting circuit 130. The latch failure detecting circuit 130 outputs a latch failure detection signal LM indicating the presence/absence of the latch failure occurrence based on the test pattern TPa and the delay shift clock DSCK.

To the clock phase controller 120, the shift clock SCK is provided from the shift clock generating circuit 10 of FIG. 1 and the latch failure detection signal LM outputted from the latch failure detecting circuit 130 is provided. Furthermore, the vertical synchronizing signal V and the discharge control timing signal SU are provided to the clock phase controller 120. The clock phase controller 120 outputs the delay shift clock DSCK by delaying the shift clock SCK based on the latch failure detection signal LM. Also, the clock phase controller 120 outputs the test pattern control signal TPC.

The serial data SDa outputted by the flip-flop circuit 110 and the delay shift clock DSCK outputted by the clock phase controller 120 are provided to the data driver 2.

Figure 5:
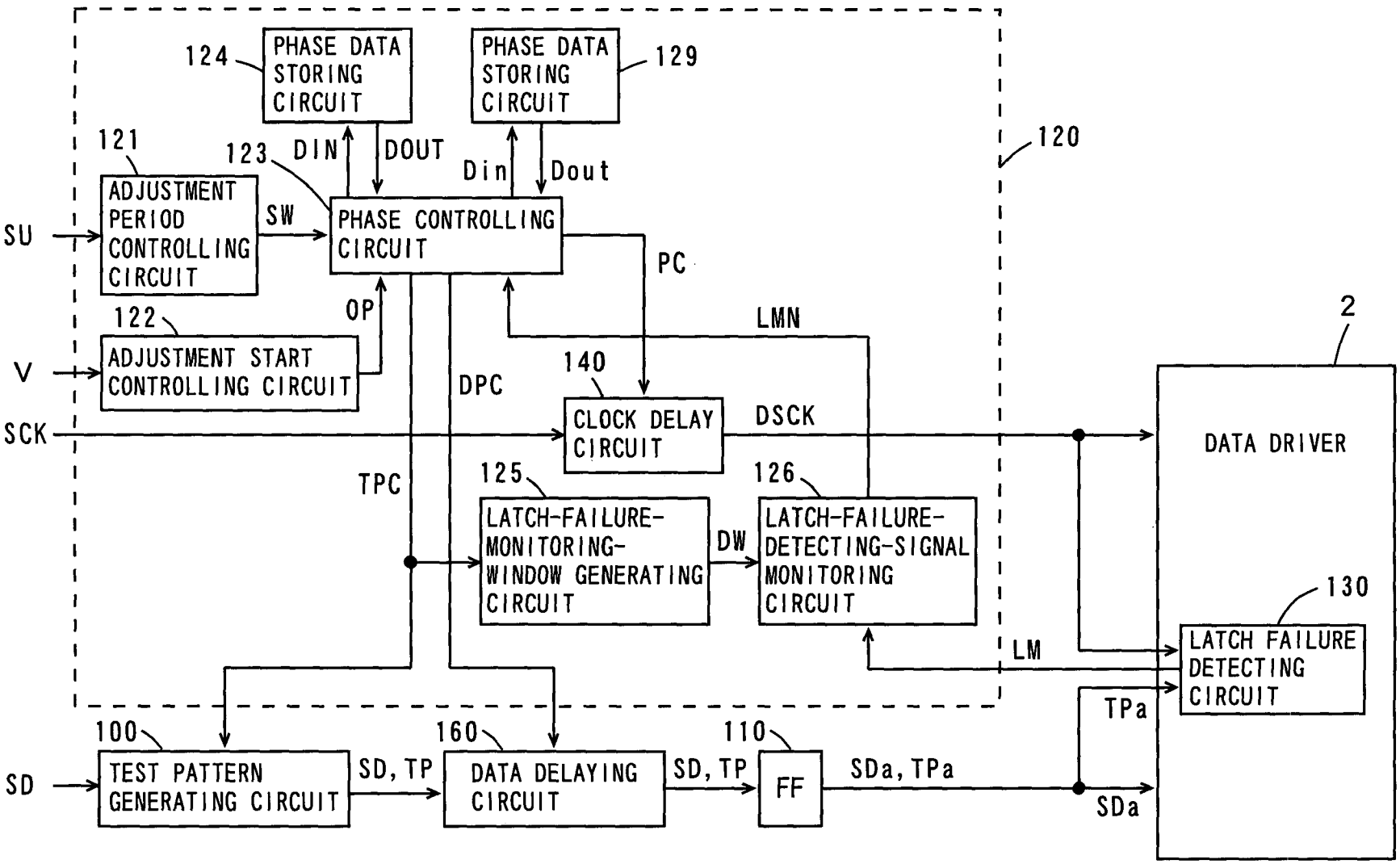
FIG. 5 is a block diagram showing an internal configuration of a clock phase controller.

FIG. 5 is a block diagram showing an internal configuration of the clock phase controller 120.

As shown in FIG. 5, the clock phase controller 120 includes an adjustment period controlling circuit 121, an adjustment start controlling circuit 122, a phase controlling circuit 123, a phase data storing circuit 124, a latch-failure-monitoring-window generating circuit 125, a latch-failure-detection-signal monitoring circuit 126, a phase data storing circuit 129 and a clock delay circuit 140.

The vertical synchronizing signal V is provided to the adjustment start controlling circuit 122. The adjustment start controlling circuit 122 outputs an adjustment period start signal OP indicating start timing of the clock phase adjustment period every three fields based on the vertical synchronizing signal V and provides the same to the phase controlling circuit 123.

The discharge control timing signal SU is provided to the adjustment period controlling circuit 121. The adjustment period controlling circuit 121 outputs an adjustment period control signal SW indicating the clock phase adjustment period, based on the discharge control timing signal SU and provides the same to the phase controlling circuit 123.

The phase controlling circuit 123 outputs the test pattern control signal TPC based on the adjustment period start signal OP and the adjustment period control signal SW in the clock phase adjustment period and at the same time, outputs a phase delay signal PC.

The shift clock SCK and the phase delay signal PC are provided to the clock delay circuit 140. The clock delay circuit 140 delays the shift clock SCK based on the phase delay signal PC, and outputs the delay shift clock DSCK.

The test pattern generating circuit 100, as described in FIG. 4, outputs the test pattern TP based on the test pattern control signal TPC.

The test pattern control signal TPC is provided to the latch-failure-monitoring-window generating circuit 125.

The latch-failure-monitoring-window generating circuit 125 outputs a detection window signal DW based on the test pattern control signal TPC and provides the same to the latch-failure-detection-signal monitoring circuit 126. The latch-failure-detection-signal monitoring circuit 126 monitors the latch failure detection signal LM outputted by the latch failure detecting circuit 130 based on the detection window signal DW. When the latch failure occurs, the latch-failure-detection-signal monitoring circuit 126 outputs a latch failure notification signal LMN and provides the same to the phase controlling circuit 123.

The phase controlling circuit 123 determines an optimal phase of the delay shift clock DSCK based on the latch failure notification signal LMN, and outputs the optimal phase as data DIN and provides the same to the phase data storing circuit 124.

The phase data storing circuit 124 stores the provided data DIN as the optimal phase of the delay shift clock DSCK. The phase data storing circuit 124 outputs the stored optimal phase as data DOUT and provides the same to the phase controlling circuit 123 in the write period.

The phase controlling circuit 123 outputs the phase delay signal PC based on the provided data DOUT and provides the same to the clock delay circuit 140.

Furthermore, after determining the delay shift clock DSCK, the phase controlling circuit 123 provides the data delay circuit 160 the phase delay signal DPC for controlling the phase of the serial data SD so that the phase of a start portion of the delay shift clock DSCK outputted to the data driver 2 and the phase of a start portion of the serial data SDa coincide with each other.

The data delay circuit 160 adjusts the phase of the serial data SDa on a clock basis (in a period of the shift clock SCK) by adjusting the delay amount of the serial data SD, based on the phase delay signal DPC.

The phase controlling circuit 123 determines, as the optimal phase, the phase of the serial data SDa adjusted so that the phase of the start portion of the delay shift clock DSCK and the phase of the start portion of the serial data SDa coincide with each other, and provides the optimal phase to the phase data storing circuit 129 as the data Din.

The phase data storing circuit 129 stores the provided data Din as the optimal phase. The phase data storing circuit 129 outputs the stored optimal phase as the data Dout and provides the same to the phase controlling circuit 123 in the write period.

The phase controlling circuit 123 outputs the phase delay signal DPC based on the provided data Dout and provides the same to the data delay circuit 160.

Figure 6:
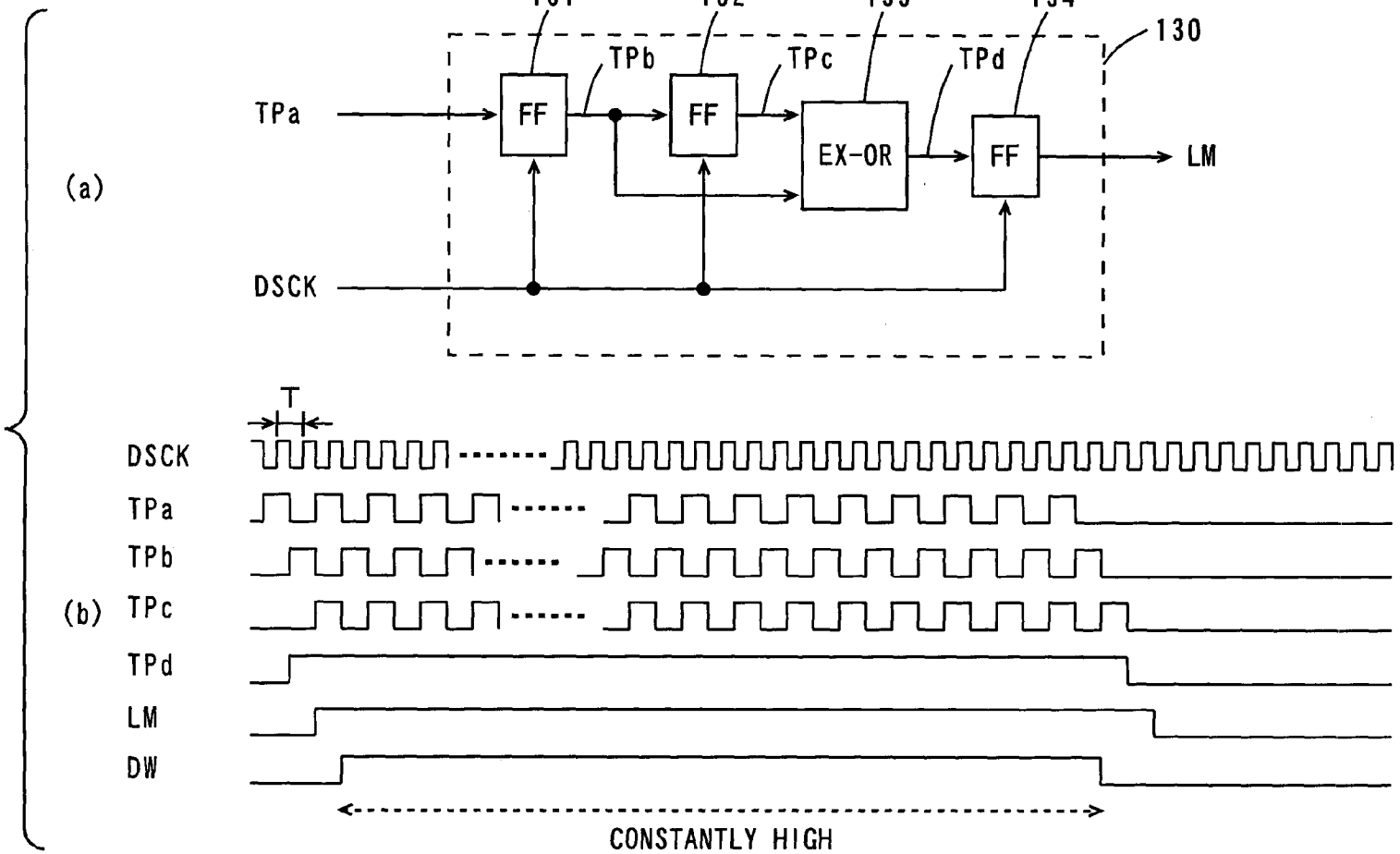
FIG. 6(*a*) is a block diagram showing an internal configuration of a latch failure detecting circuit of FIG. 4, and FIG. 6(*b*) is a timing diagram showing signals of respective portions in the latch failure detecting circuit.

FIG. 6(*a*) is a block diagram showing a configuration of the latch failure detecting circuit 130 of FIG. 4. FIG. 6(*b*) is a timing diagram showing the signals of the respective portions in the latch failure detecting circuit 130 of FIG. 6(*a*).

As shown in FIG. 6(*a*), the latch failure detecting circuit 130 includes flip-flop circuits 131, 132, 134 and an exclusive OR (Hereinafter, referred to as EX-OR) circuit 133.

The delay shift clock DSCK and the test pattern TPa shown in FIG. 6(*b*) are provided to the flip-flop circuit 131.

As shown in FIG. 6(*b*), a period of the delay shift clock DSCK (hereinafter, referred to as clock period) is T. The test pattern TPa is an alternating pulse signal that is inverted in the period T of the delay shift clock DSCK. The flip-flop circuit 131 latches the test pattern TPa at the fall of the delay shift clock DSCK, and outputs a test pattern TPb which is delayed by one clock c period T with respect to the test pattern TPa.

The test pattern TPb and the delay shift clock DSCK are provided to the flip-flop circuit 132. The flip-flop circuit 132 latches the test pattern TPb at the fall of the delay shift clock DSCK and outputs a test pattern TPc which is delayed by one clock period T with respect to the test pattern TPb.

The test patterns TPb, TPc are provided to the EX-OR circuit 133. The EX-OR circuit 133 outputs an EX-OR of the test patterns TPb, TPc as a test pattern TPd. When no latch failure occurs in the test patterns TPa, TPb, TPc, the test pattern TPd is kept in a high state.

The test pattern TPd and the delay shift clock DSCK are provided to the flip-flop circuit 134. The flip-flop circuit 134 latches the test pattern TPd at the fall of the delay shift clock DSCK and outputs the latch failure detection signal LM which is delayed by one clock period T with respect to the test pattern TPd.

The detection window signal DW shown in FIG. 6(*b*) is outputted from the latch-failure-monitoring-window generating circuit 125 shown in FIG. 5. If there is a low portion in the latch failure detection signal LM in a period when the detection window signal DW is high, then it is determined that a latch failure occurs. In this case, as shown in FIG. 5, the latch failure notification signal LMN is outputted from the latch-failure-detection-signal monitoring circuit 126.

Figure 7:
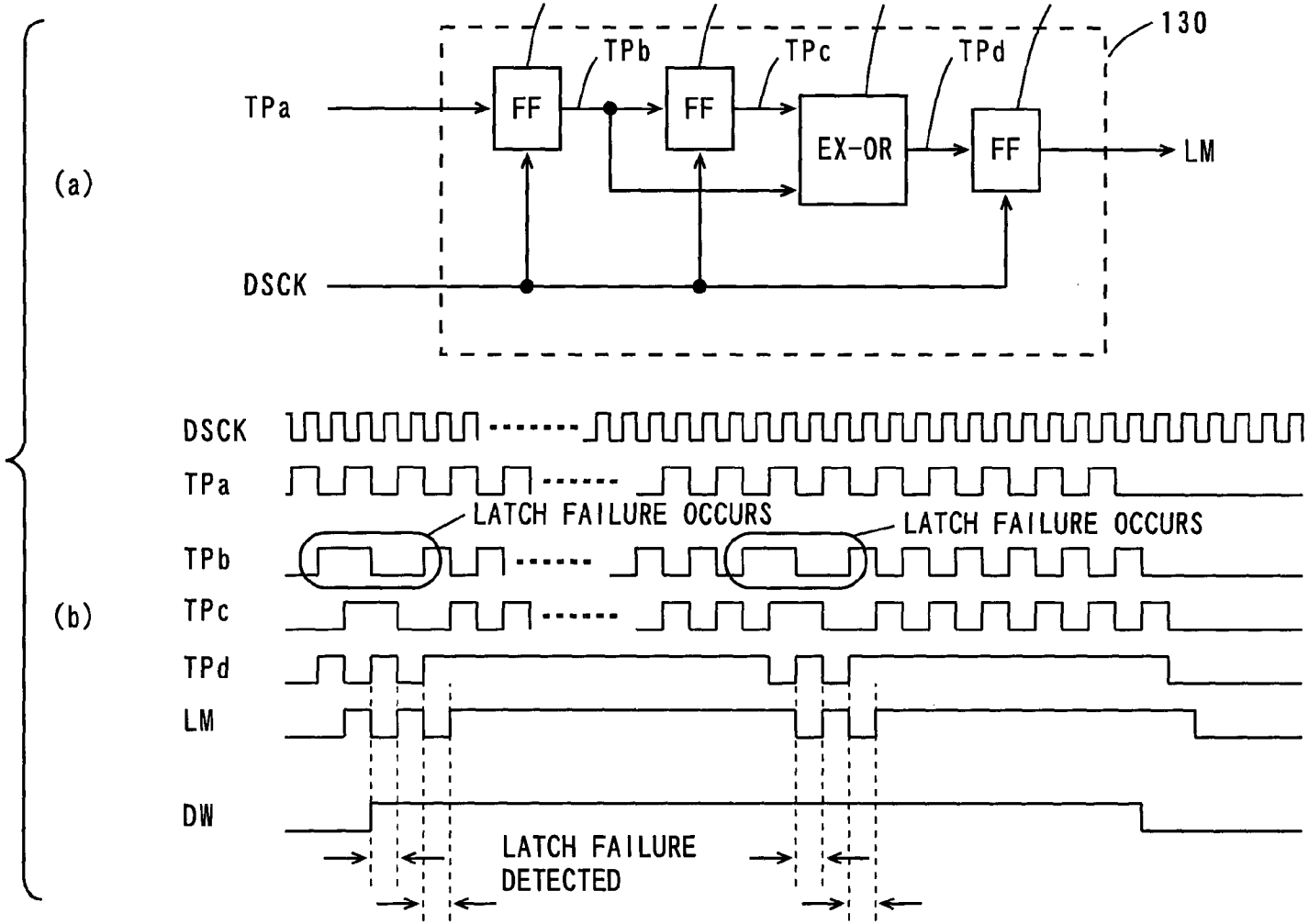
FIG. 7 is a diagram for explaining the detection of a latch failure.

FIG. 7 is a diagram for explaining the detection of the latch failure. FIG. 7(*a*) is a block diagram showing a configuration of the latch failure detecting circuit 130, similar to FIG. 6(*a*). FIG. 7(*b*) is a timing diagram showing the signals of the respective portions in the latch failure detecting circuit 130.

Here, a case where the latch failure occurs in the flip-flop circuit 131 is considered. As shown in FIG. 7(*b*), the test pattern TPb comes to keep a high or low portion in successive two clock periods 2T or more without being inverted in one clock period T due to the latch failure in the flip-flop circuit 131. This also causes the test pattern TPc to keep a high or low portion in successive two clock periods 2T or more without being inverted in one clock period T.

The test pattern TPd comes to have a low portion because it is the EX-OR of the test pattern TPb and the test pattern TPc. This also causes the latch failure detection signal LM to have a low portion. Accordingly, the latch failure notification signal LMN is outputted from the latch-failure-detection monitoring circuit 126 of FIG. 5.

As described above, when the latch failure of the test pattern TPa occurs, the latch failure detection signal LM comes to have a low portion. Accordingly, based on whether or not the latch failure detection signal LM has a low portion in the period when the detection window signal DW is high, the presence/absence of the latch failure can be determined.

Figure 8:
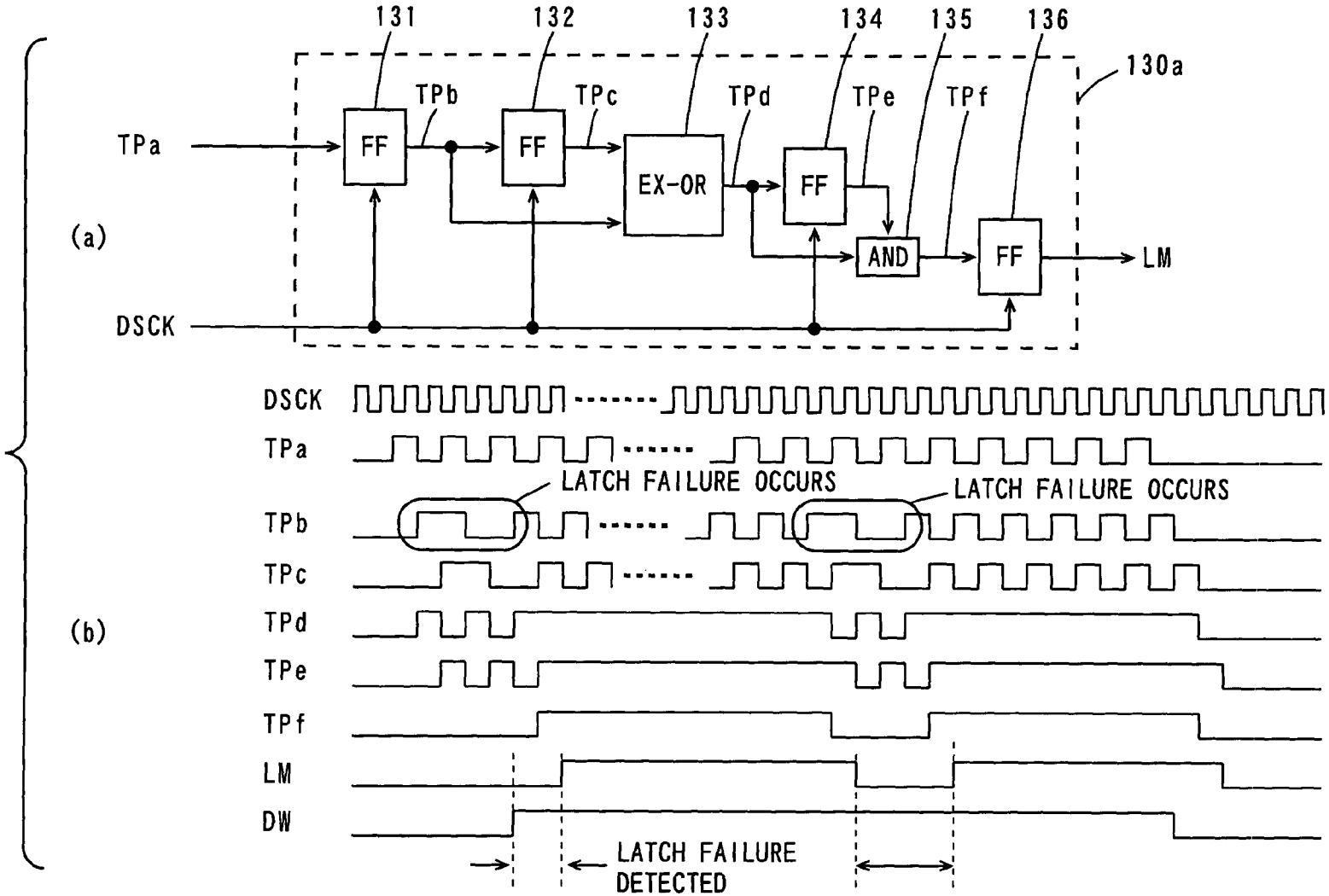
FIG. 8(*a*) is a block diagram showing another example of the latch failure detecting circuit, and FIG. 8(*b*) is a timing diagram showing signals of respective portions in the latch failure detecting circuit.

FIG. 8(*a*) is a block diagram showing another example of the latch failure detecting circuit. FIG. 8(*b*) is a timing diagram showing the signals of the respective portions in the latch failure detecting circuit of FIG. 8(*a*).

A different point of a latch failure detection circuit 130*a* shown in FIG. 8(*a*) from the latch failure detecting circuit 130 is that it further includes an AND circuit 135 and a flip-flop circuit 136. The test pattern TPd outputted by the EX-OR circuit 133 and a test pattern Tpe outputted by the flip-flop circuit 134 are provided to the AND circuit 135. The AND circuit 135 outputs an AND of the test patterns TPd, Tpe as a test pattern TPf.

The test pattern TPf and the delay shift clock DSCK are provided to the flip-flop circuit 136. The flip-flop circuit 136 latches the test pattern TPf at the fall of the delay shift clock DSCK, and outputs the latch failure detection signal LM which is delayed by one clock period T with respect to the test pattern TPf.

Here, a case where the latch failure described in FIG. 7(*b*) occurs is considered. In this case, as described in FIG. 7(*b*), the test pattern TPd outputted from the EX-OR circuit 133 has a low portion. This causes the test pattern TPf, which is an AND with the test pattern Tpe, to have a low portion with a width larger than the low portion of the test pattern TPd by one clock period T. Accordingly, detection accuracy of the latch failure is improved.

Figure 9:
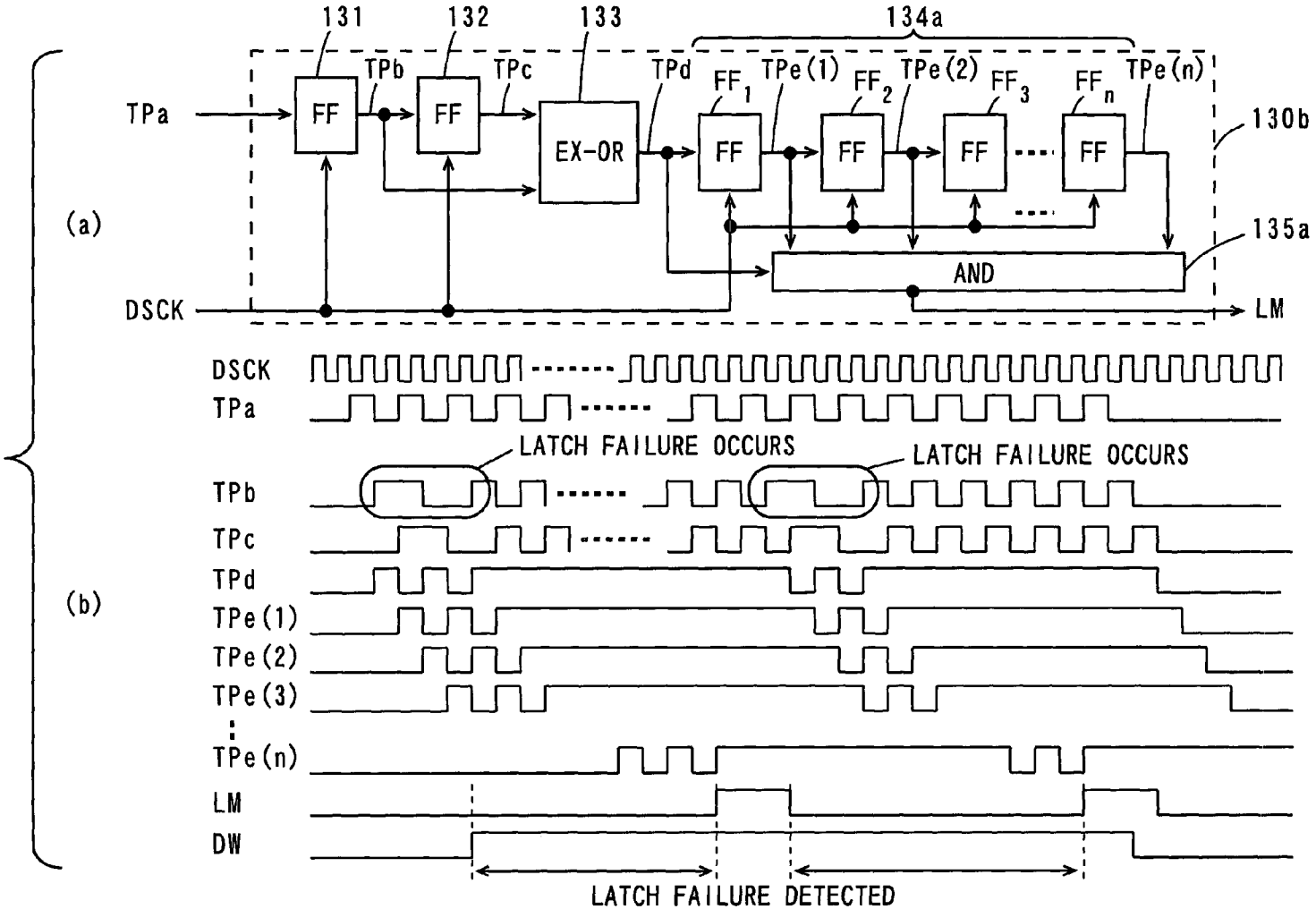
FIG. 9(*a*) is a block diagram showing still another example of the latch failure detecting circuit, and FIG. 9(*b*) is a timing diagram showing signals of respective portions in the latch failure detecting circuit.

FIG. 9(*a*) is a block diagram showing still another example of the latch failure detecting circuit. FIG. 9(*b*) is a timing diagram showing the signals of the respective portions in the latch failure detecting circuit of the FIG. 9(*a*).

A different point of a latch failure detecting circuit 130*b* shown in FIG. 9(*a*) from the latch failure detecting circuit 130 shown in FIG. 6 is that it further includes a test pattern delay unit 134*a* and an AND circuit 135*a*.

The test pattern delay unit 134*a* has a configuration in which a first to n-th flip-flop circuit $FF_1$, $FF_2$, . . . , $FF_n$ are connected in series. Here, n is an integer of two or more. The test pattern TPd and the delay shift clock DSCK are provided to the flip-flop circuit $FF_1$ of the test pattern delay unit 134*a*. The first flip-flop circuit $FF_1$ latches the test pattern TPd at the fall of the delay shift clock DSCK and outputs the test pattern Tpe(1) which is delayed by one clock period T with respect to the test pattern TPd.

The test pattern Tpe(1) and the delay shift clock DSCK are provided to the second flip-flop circuit $FF_2$. The second flip-flop circuit $FF_2$ latches the test pattern Tpe(1) at the fall of the delay shift clock DSCK and outputs the test pattern Tpe(2) which is delayed by one clock period T with respect to the test pattern Tpe(1).

Similarly, the n-th flip-flop circuit $FF_n$ outputs a test pattern Tpe(n).

The test pattern TPd outputted from the EX-OR circuit 133 and the test patterns Tpe(1) to Tpe(n) outputted by the first to n-th flip-flop circuits $FF_1$ to $FF_n$ in the test pattern delay unit 134*a* are provided to the AND circuit 135*a*. The AND circuit 135*a* outputs an AND of the provided test patterns TPd, Tpe(1) to Tpe(n) as the latch failure detection signal LM.

Here, suppose the latch failure described in FIG. 7(*b*) occurs. In this case, as described in FIG. 7(*b*), the test pattern TPd outputted from the EX-OR circuit 133 has a low portion. Since the latch failure detection signal LM outputted by the AND circuit 135*a* is the AND of the (n+1) test patterns TPd, TPe(1) to TPe(n), which are sequentially delayed by one clock period T, the latch failure detection signal LM has a low portion with a width larger than the low portion of the test pattern TPd by n clock periods T. Accordingly, the detection accuracy of the latch failure is more improved.

Figure 10:
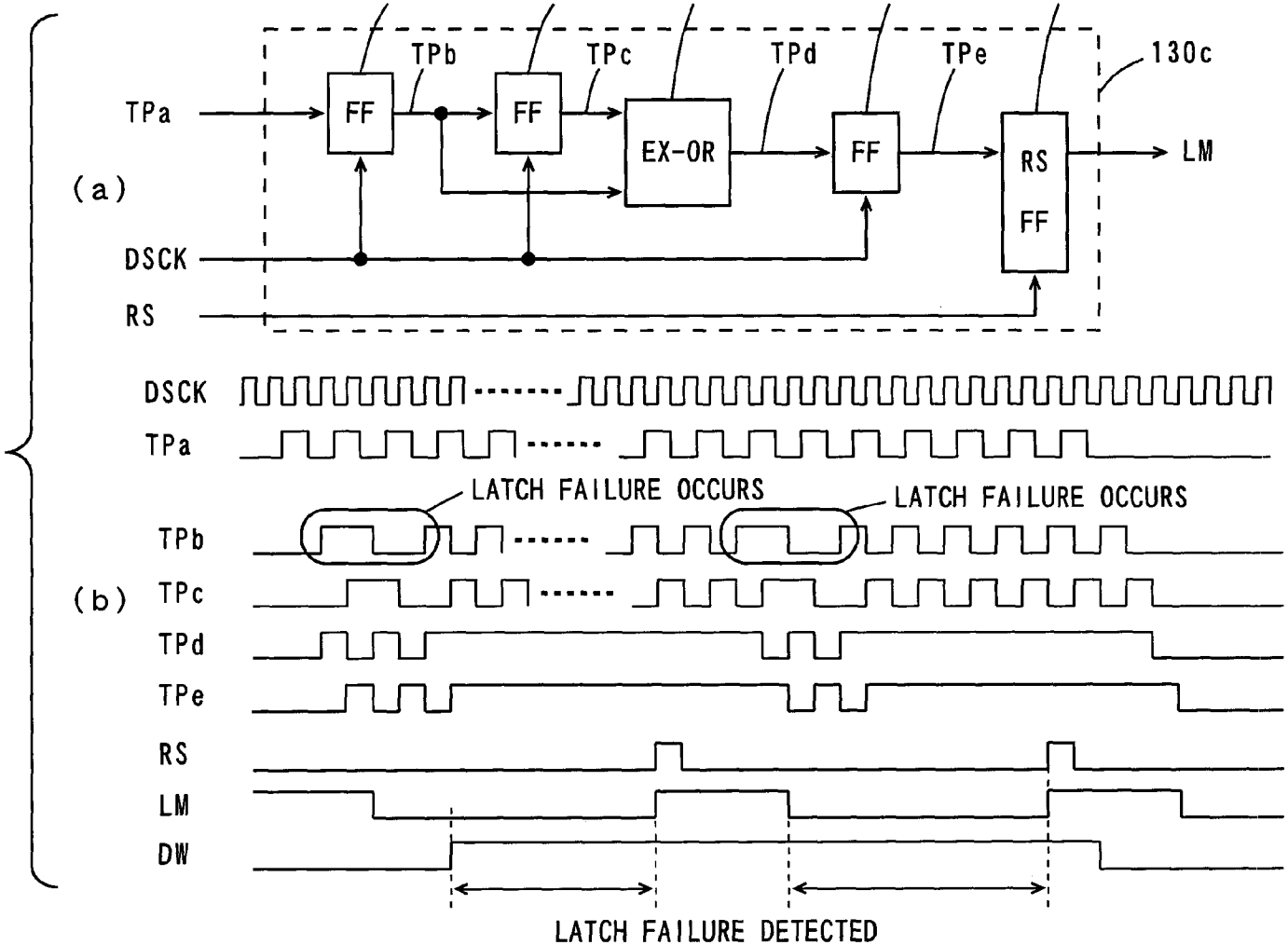
FIG. 10(*a*) is a block diagram showing still another example of the latch failure detecting circuit, and FIG. 10(*b*) is a timing diagram showing signals of respective portions in the latch failure detecting circuit.

FIG. 10(*a*) is a block diagram showing still another example of the latch failure detecting circuit. FIG. 10(*b*) is a timing diagram showing the signals of the respective portions in the latch failure detecting circuit of FIG. 10(*a*).

A different point of a latch failure detecting circuit 130*c* of FIG. 10 from the latch failure detecting circuit 130 of FIG. 6 is that it further includes an RS flip-flop circuit 137. The test pattern TPe and a reset signal RS are provided to the RS flip-flop circuit 137. When the reset signal RS rises to be high, the RS flip-flop circuit 137 is reset, so that the latch failure detection signal LM becomes high.

If the latch failure described in FIG. 7(*b*) occurs, the test pattern TPd outputted from the EX-OR circuit 133 has a low portion. This also causes the test pattern TPe, which is delayed by one clock period T from the test pattern TPd, to have a low portion.

When the test pattern TPe provided to the RS flip-flop circuit 137 falls to be low, the latch failure detection signal LM outputted from the RS flip-flop circuit 137 is kept in a low state. This increases the width of the latch failure detection signal LM. Accordingly, the detection accuracy of the latch failure is more improved.

When the resent signal RS rises to be high, the latch failure detection signal LM becomes high. The reset signal RS is raised to be high before the latch failure detection operation.

Figure 11:
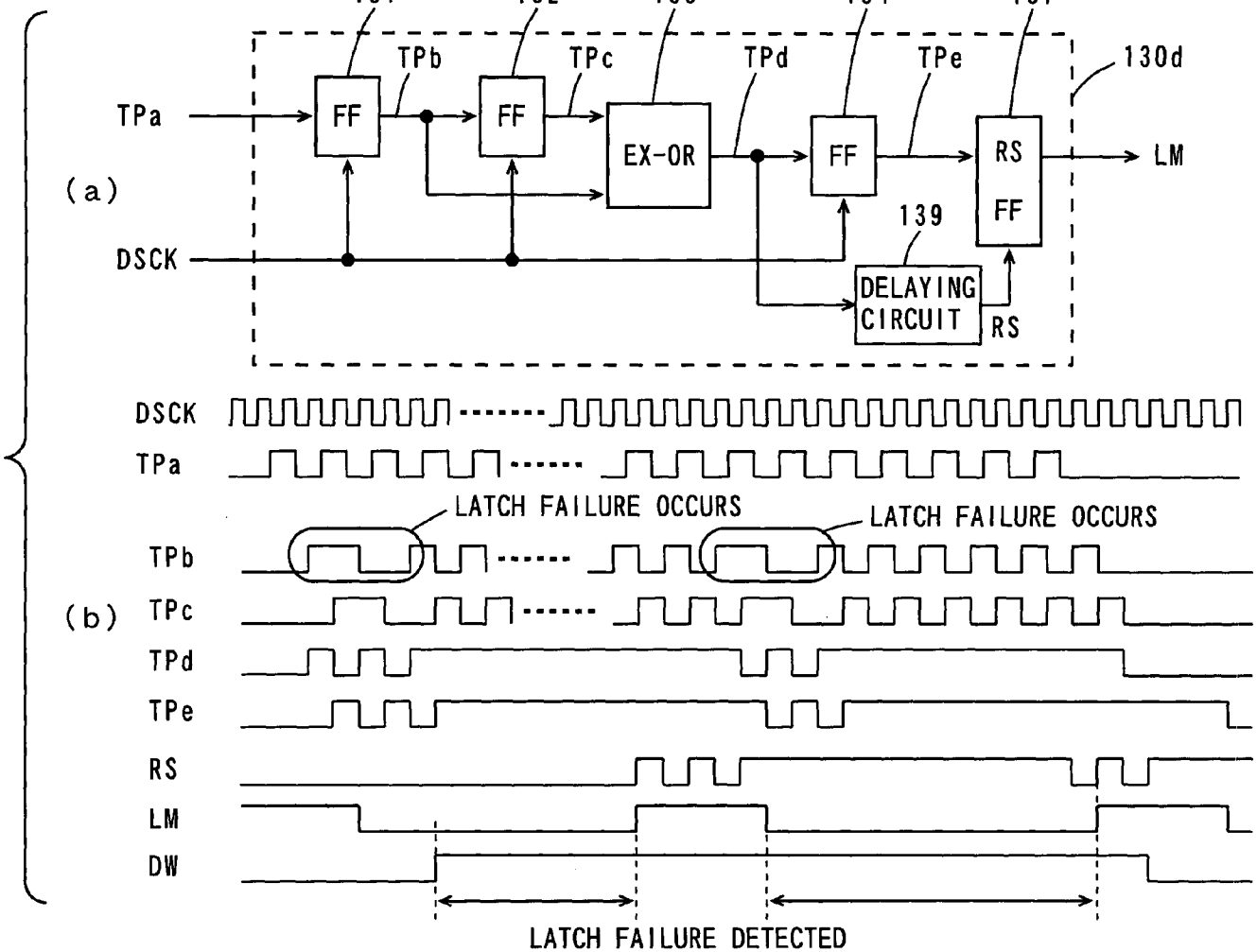
FIG. 11(*a*) is a block diagram showing still another example of the latch failure detecting circuit, and FIG. 11(*b*) is a timing diagram showing signals of respective portions in the latch failure detecting circuit of FIG. 11(*a*)

FIG. 11(*a*) is a block diagram showing still another example of the latch failure detecting circuit. FIG. 11(*b*) is a timing diagram showing the signals of the respective portions in the latch failure detecting circuit of FIG. 11(*a*).

A different point of a latch failure detection circuit 130*d* of FIG. 11 from the latch failure detecting circuit 130*c* of FIG. 10 is that it further includes a delay circuit 139.

The delay circuit 139 may be made of a monostable multivibrator. In this case, the delay amount can be adjusted by a delay adjusting circuit (external resistance) for the monostable multivibrator. The delay circuit 139 may be made of a counter circuit. In this case, the control of the stable delay amount is possible.

The delay circuit 139 delays the test pattern TPd outputted from the EX-OR circuit 133 by a given time and provides the delayed test pattern TPe to the RS flip-flop circuit 137 as the reset signal RS. When the reset signal RS rises to be high, the RS flip-flop circuit 137 is reset, so that the latch failure detection signal LM becomes high.

If the latch failure described in FIG. 7(*b*) occurs, the test pattern TPd outputted from the EX-OR circuit 133 has a low portion. This also causes the test pattern TPe, which is delayed by one clock period T from the test pattern TPd, to have a low portion.

When the test pattern TPe provided to the RS flip-flop circuit 137 falls to be low, the latch failure detection signal LM outputted from the RS flip-flop circuit 137 is kept in a low state. This increases the width of the latch failure detection signal LM. Accordingly, the detection accuracy of the latch failure is more improved.

When the latch failure becomes absent, the test pattern TPd becomes high, and the test pattern TPe also becomes high. After a predetermined time has passed, the reset signal RS becomes high. As a result, the latch failure detection signal LM becomes high.

Figure 12:
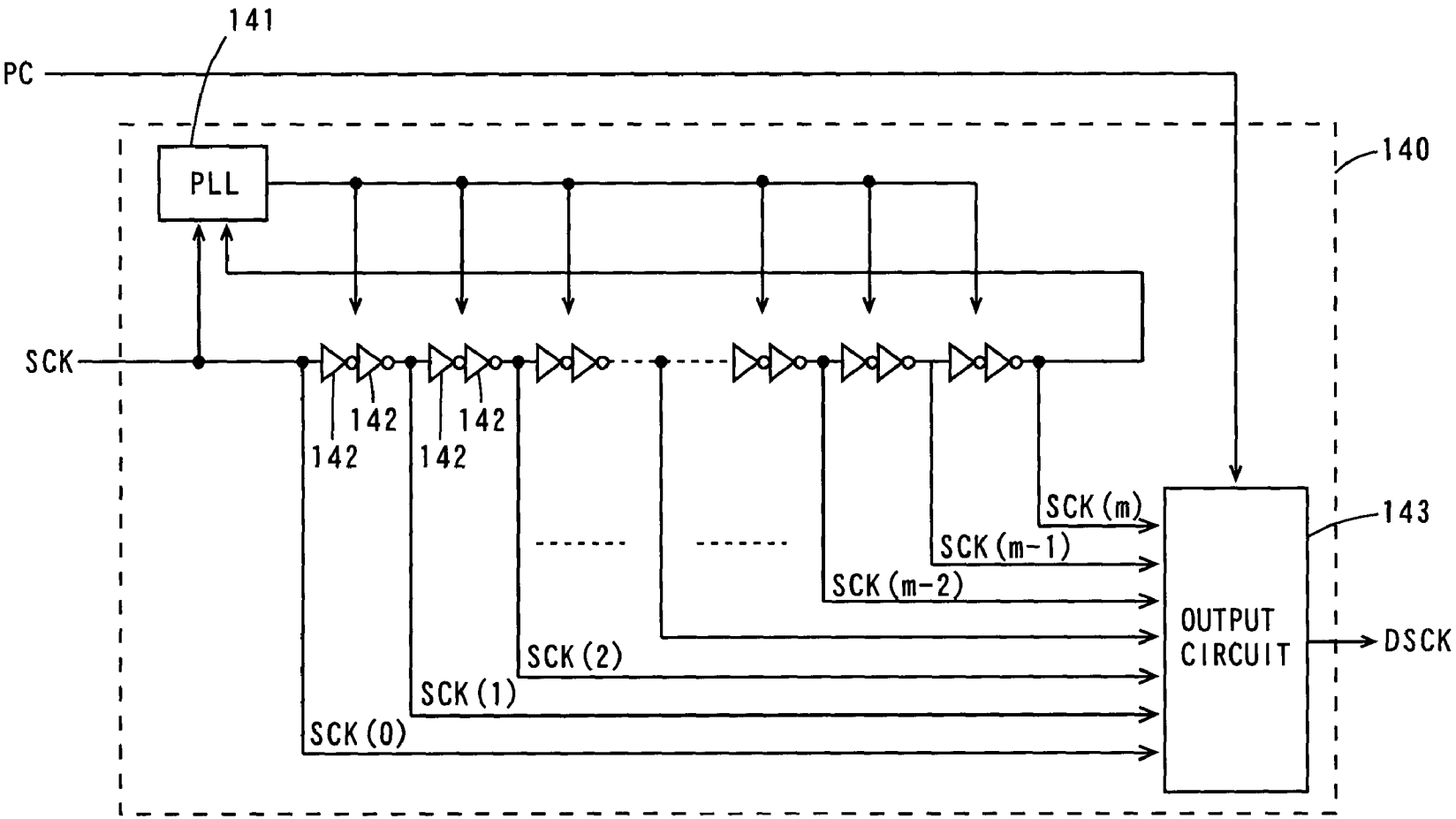
FIG. 12 is a block diagram showing an internal structure of a clock delay circuit of FIG. 5.

FIG. 12 is a block diagram showing a configuration of a clock delay circuit 140 of FIG. 5.

As shown in FIG. 12, the clock delay circuit 140 is made of a PLL circuit 141, 2m inverters 142, and an output circuit 143. Here, the 2m inverts 142 are circularly connected.

The shift clock SCK and the output of the inverter 142 at the final stage are provided to the PLL circuit 141. The shift clock SCK is provided to the inverter 142 at the first stage and the output circuit 143. The outputs of the inverters 142 at even-numbered stages are provided to the next inverters 142 and the output circuit 143 as the shift clocks SCK(1) to SCK(m), respectively. The delay amount of the signal by the two inverters 142 is referred to as one unit amount.

The PLL circuit 141 controls the one unit amount of delay, for example, by controlling power supply for operating voltage so that the phase of the shift clock SCK and the phase of the shift clock SCK(m) coincide with each other. Thus, one unit amount becomes equivalent to 1/(m+1) period of the shift clock SCK. Accordingly, the shift clocks SCK(0) to SCK(m) have the phases sequentially delayed by one unit amount.

The output circuit 143 outputs one of the shift clocks SCK (0) to SCK(m) as the delay shift clock DSCK, based on the phase delay signal PC.

In the clock delay circuit 140 according to the present embodiment, since the control is performed by the PLL circuit 141 so that the phase of the shift clock SCK and the phase of the shift clock SCK(m) coincide with each other, fluctuations in delay amount due to temperature changes can be suppressed.

Figure 13:
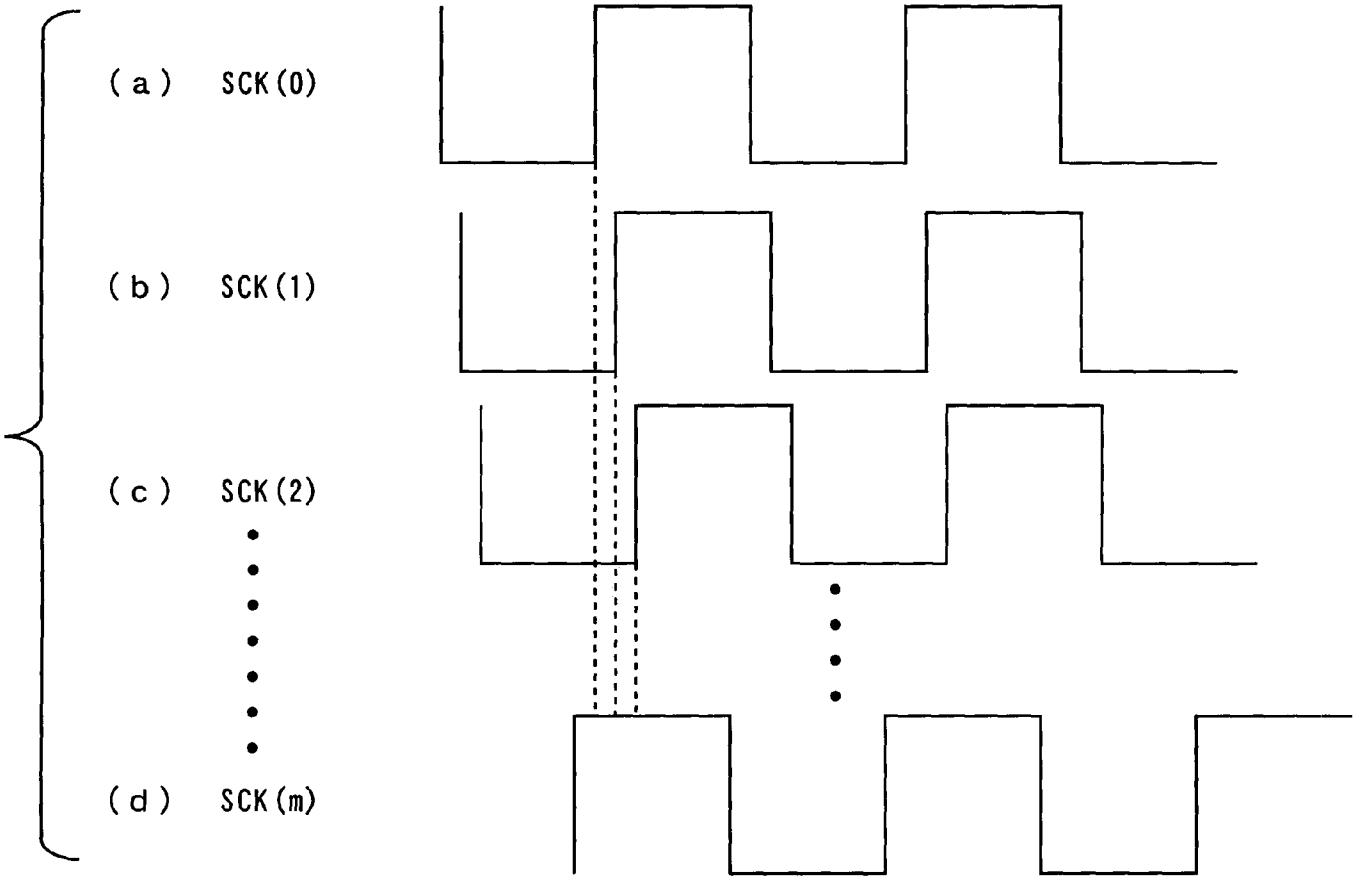
FIG. 13 is a waveform diagram showing waveforms of (m+1) signals of a shift clock SCK(0) to a shift clock SCK(m) described in FIG. 11.

FIG. 13(*a*) is a waveform diagram of the shift clock SCK (0), FIG. 13(*b*) is a waveform diagram of the shift clock SCK(1), FIG. 13(*c*) is a waveform diagram of the shift clock SCK(2), and FIG. 13(*d*) is a waveform diagram of the shift clock SCK(m).

As shown in FIG. 13, the phases of the shift clock SCK(0), the shift clock SCK(1) and the shift clock SCK(2) are sequentially delayed by one unit amount.

Figure 14:
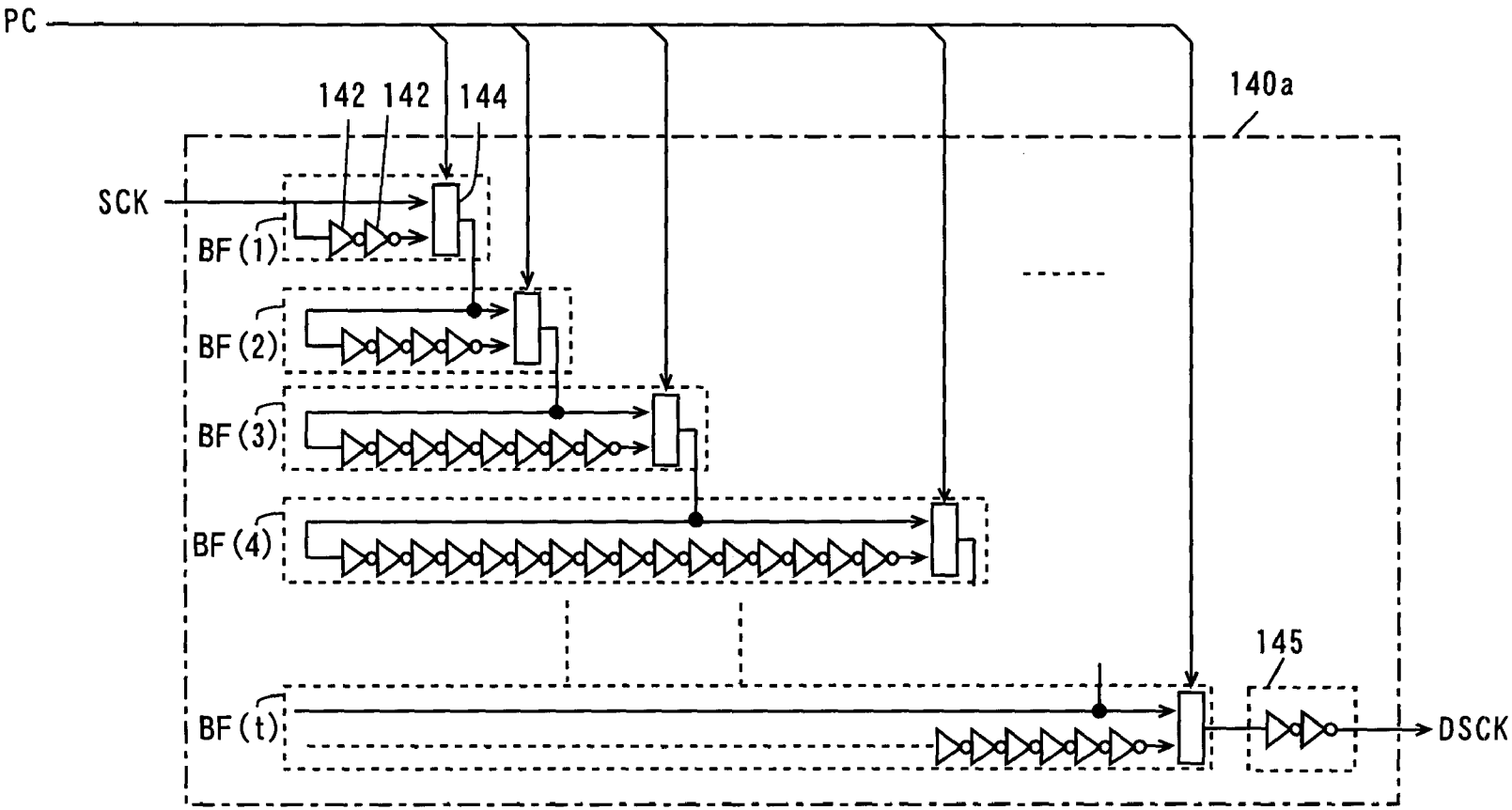
FIG. 14 is a diagram showing another example of the clock delay circuit.

FIG. 14 is a diagram showing another example of the clock delay circuit.

A clock delay circuit 140*a* shown in FIG. 14 is made of t delay circuits BF(1) to BF(t) and a delay circuit 145. The delay circuit 145 has a configuration in which, for example, two inverters 142 are connected in series. Instead of two inverters 142, one buffer can be used to make up the delay circuit 145.

The delay circuit BF(1) is made of $2^1=2$ inverters 142 connected in series and an output circuit 144. The delay circuit BF(2) is made of $2^2=4$ inverters 142 connected in series and the output circuit 144. The delay circuit BF (3) is made of $2^3=8$ inverters 142 connected in series and the output circuit 144. Similarly, the delay circuit BF(t) is made of $2^t$ inverters 142 connected in series and the output circuit 144.

The shift clock SCK is provided to the delay circuit BF(1) The shift clock SCK is branched into two in the delay circuit BF(1), so that one is provided to the output circuit 144 and the other passes through the two inverters 142 connected in series with delay of $2^0=1$ unit amount and is provided to the output circuit 144. The output circuit 144 provides any one of the shift clock SCK and the shift clock SCK delayed by one unit amount to the delay circuit BF(2), based on the phase delay signal PC.

The shift clock SCK provided to the delay circuit BF(2) is branched into two in the delay circuit BF(2), so that one is provided to the output circuit 144 and the other passes through the four inverters 142 connected in series with delay of $2^1=2$ unit amount and is provided to the output circuit 144. The output circuit 144 provides any one of the shift clock SCK provided from the delay circuit BF(1) and the shift clock SCK delayed by two unit amount from the shift clock SCK provided from the delay circuit BF(1) to the delay circuit BF(3), based on the phase delay signal PC.

Similarly, the shift clock SCK provided to the delay circuit BF(t) is branched into two in the delay circuit BF(t), so that one is provided to the output circuit 144 and the other passes through the $2^t$ inverters 142 connected in series with delay of $2^{t-1}$ unit amount and is provided to the output circuit 144. The output circuit 144 provides any one of the shift clock SCK provided from the delay circuit BF(t−1) and the shift clock SCK delayed by $2^{t-1}$ unit amount from the shift clock SCK provided from the delay circuit BF(t−1) to the delay circuit 145, based on the phase delay signal PC.

The shift clock SCK provided to the delay circuit 145 passes through the two inverters 142 with delay of one unit amount and is outputted as the delay shift clock DSCK.

From the foregoing, the shift clock SCK passes through the delay circuits BF(1) to BF(t), so as to be delayed by the unit amount of combination of $2^0, 2^1, 2^2, \ldots 2^{t-1}$ unit amount and further delayed by one unit amount by the delay circuit 145 and is outputted as the delay shift clock DSCK. According to the combination of $2^0, 2^1, 2^2, \ldots 2^{t-1}$, all integers of $2^0$ to $2^t$ can be combined.

Figure 15:
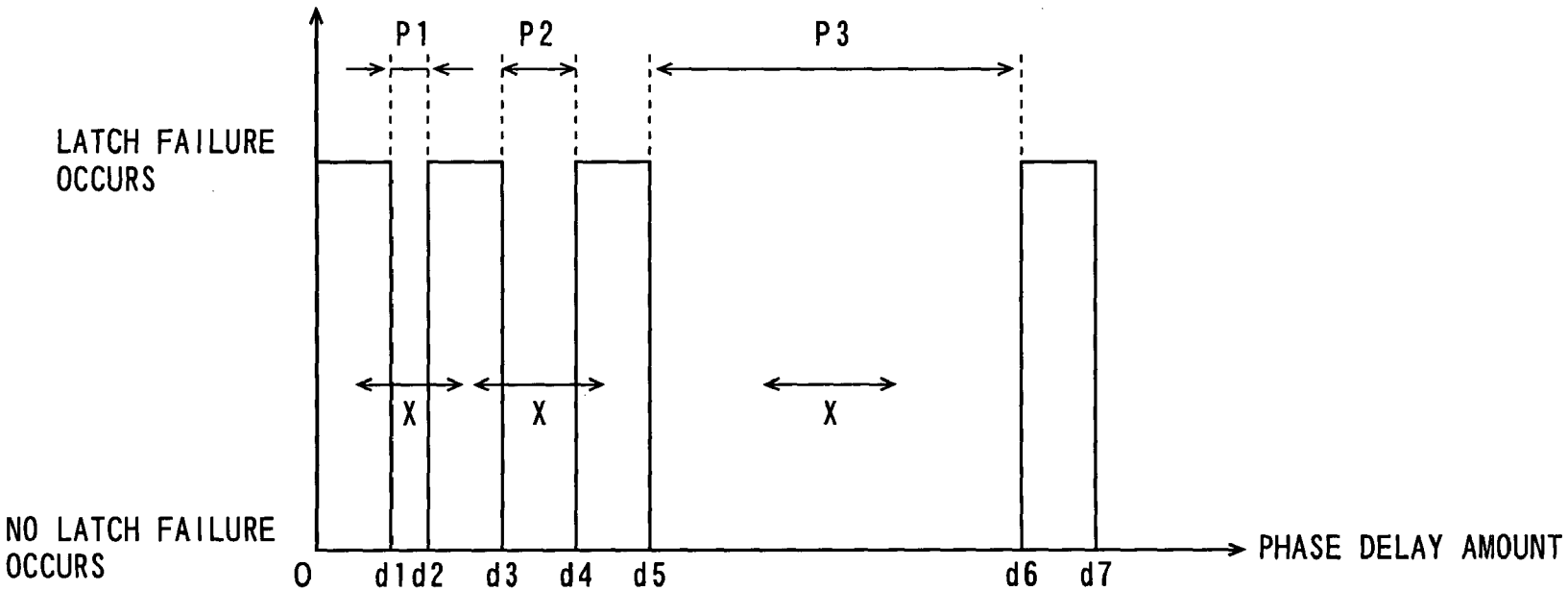
FIG. 15 is a diagram for explaining an optimal phase of a delay shift clock.

FIG. 15 is a diagram for explaining the optimal phase of the delay shift clock DSCK. The axis of ordinate of FIG. 15 indicates the presence/absence of the latch failure occurrence and the axis of abscissas indicates the phase delay amount of the delay shift clock DSCK with respect to the shift clock SCK. Here, a case where the presence/absence of the latch failure is as shown in FIG. 15 according to the delay amount of the delay shift clock DSCK is considered.

As shown in FIG. 15, the latch failure occurs between the phase delay amounts 0 and d1, between d2 and d3, between d4 and d5 and between d6 and d7. On the other hand, no latch failure occurs between the phase delay amounts d1 and d2, between d3 and d4 and between d5 and d6. The portion between the phase delay amounts d1 and d2 is defined as a latch failure non-occurrence region P1, the portion between d3 and d4 is defined as a latch failure non-occurrence region P2, and the portion between d5 and d6 is defined as the latch failure non-occurrence region P3.

When a width of the latch failure non-occurrence region is larger than a threshold X, the phase delay amount in the center of the latch failure non-occurrence region is set as an optimal phase of the delay shift clock DSCK.

In the case of FIG. 15, since the widths of the latch failure non-occurrence regions P1, P2 are smaller than the threshold X, the optimal phase of the shift clock DSCK is not set within the latch failure non-occurrence regions P1, P2.

In contrast, since the width of the latch failure non-occurrence region P3 is larger than the threshold X, the phase delay amount in the center of the latch failure non-occurrence region P3 ((d5+d6)/2) is set as the optimal phase of the delay clock DSCK. Thus, the optimal phase of the delay shift clock DSCK is set to a phase delayed by ((d5+d6)/2) with respect to the shift clock SCK.

As described above, since the optimal phase of the delay shift clock DSCK is set from the latch failure non-occurrence region having a sufficiently large width, the accuracy at which the optimal phase of the delay shift clock DSCK is detected is improved.

Figure 16:
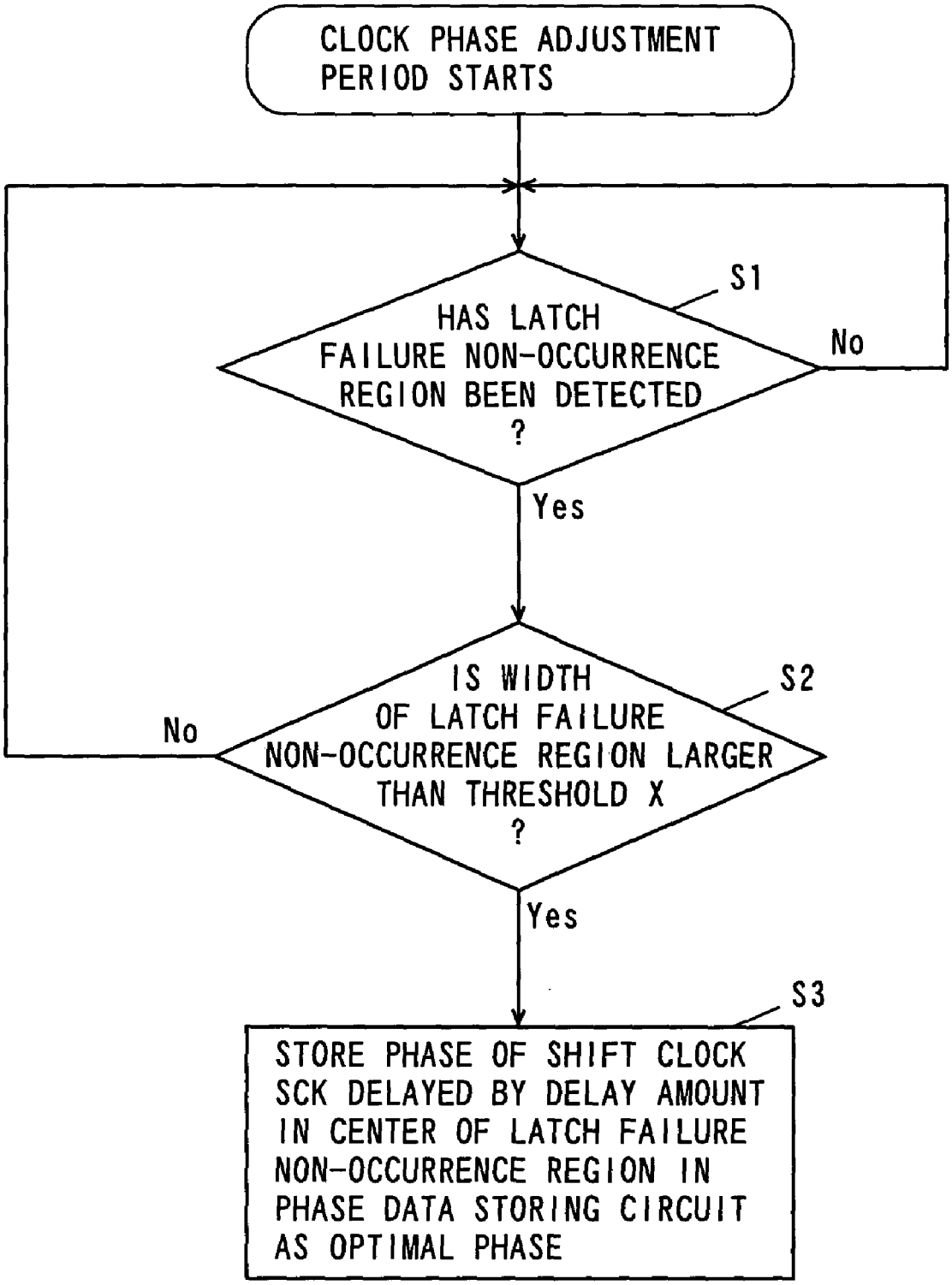
FIG. 16 is a flowchart showing one example of operation of a phase controlling circuit for detecting the optimal phase of the delay shift clock.

FIG. 16 is a flowchart showing one example of operation of the phase controlling circuit 123 for detecting the optimal phase of the delay shift clock DSCK. Hereinafter, a description of the flowchart of FIG. 16 is given, in reference to FIGS. 15 and 16.

As shown in FIG. 16, the phase controlling circuit 123 determines whether or not a latch failure non-occurrence region has been detected (step S1). If the phase controlling circuit 123 has detected a latch failure non-occurrence region, then it is determined whether or not the width of the latch failure non-occurrence region is larger than the threshold X (step S2).

If the phase controlling circuit 123 determines that the width of the latch failure non-occurrence region is larger than the threshold X, the phase obtained by delaying the shift clock SCK by the phase delay amount in the center of the latch failure non-occurrence region is stored in the phase data storing circuit 124 as the optimal phase of the delay shift clock DSCK (step S3).

In step S1, if no latch failure non-occurrence region is detected, the phase controlling circuit 123 stands by. In step S2, if the phase controlling circuit 123 determines that the phase interval of the latch failure non-occurrence region is smaller than the threshold X, the operation is repeated from step S1.

Figure 17:
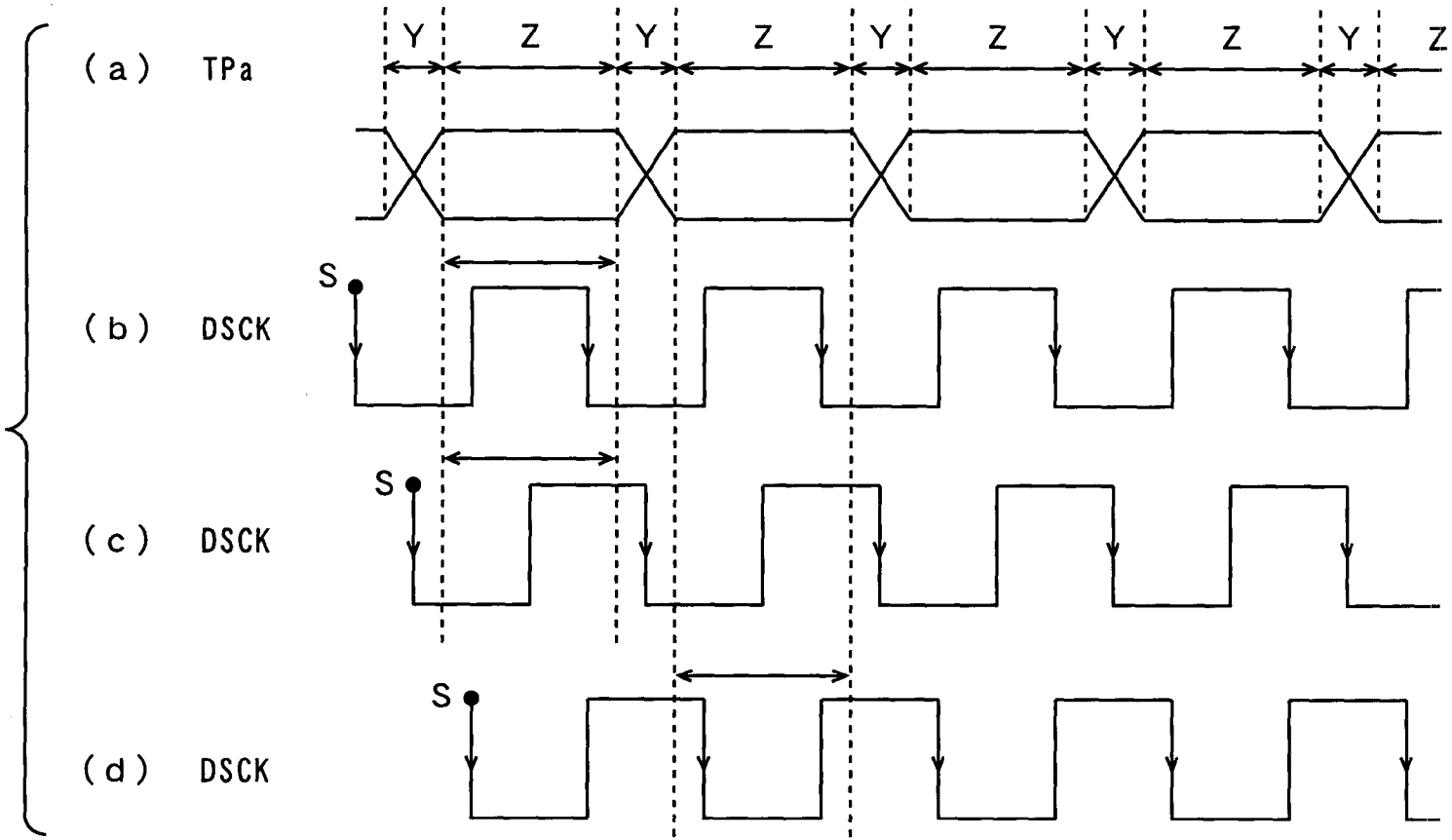
FIG. 17 is a diagram for explaining the number of clocks required for the detection of the optimal phase of the delay shift clock.

FIG. 17 is a diagram for explaining the number of clocks required for the detection of the optimal phase of the delay shift clock DSCK.

FIG. 17(*a*) is a waveform diagram of the test pattern TPa, and FIGS. 17(*b*) to 17(*d*) are waveform diagrams of the delay shift clocks DSCK different from each other in phase.

If the test pattern Tpa having an alternating pulse waveform is latched when it is switched between high and low, the latch failure easily occurs. Accordingly, in FIG. 17(*a*), the latch failure easily occurs in a region Y.

The phase in which the fall of the shift clock SCK is delayed by the phase delay amount 0 to d5 of FIG. 15 is equivalent to the region Y of FIG. 17 and the phase in which the fall of the shift clock SCK is delayed by the phase delay amount d5 to d7 is equivalent to a region Z of FIG. 17.

As described in FIG. 15, the region Z needs to be detected in order to detect the optimal phase of the delay shift clock DSCK. Since the optimal phase of the delay shift clock DSCK is in the center of the region Z, a boundary between the region Y and the region Z needs to be detected. Accordingly, two continuous regions Y need to be detected.

Suppose that the clock phase adjustment period starts at the fall of the shift clock SCK and that its phase is a phase S.

As shown in FIG. 17(*b*), when the phase S starts immediately before the first region Y of the test pattern TPa, as in FIG. 17(*b*), the phase of the shift clock SCK needs to be delayed from the phase of the boundary between the first region Y and the first region Z to the phase at the boundary between the first region Z and the second region Y. Accordingly, if the shift clock SCK is delayed by two clocks from the phase S, the optimal phase is detected.

As shown in FIG. 7(*c*), when the phase S starts at the first region Y of the test pattern TPa, the phase of the shift clock SCK needs to be delayed from the phase at the boundary between the first region Y and the first region Z to the phase at the boundary between the first region Z and the second region Y. Accordingly, if the shift clock SCK is delayed by two clocks from the phase S, the optimal phase delay amount is detected.

On the other hand, as shown in FIG. 17(*d*), when the phase S starts in the middle of the first region Z of the test pattern TPa, the phase of the shift clock SCK needs to be delayed from the phase at the boundary between the second region Y and the second region Z to the phase at the boundary between the second region Z and the third region Y. Accordingly, if the shift clock SCK is delayed by two clocks from the phase S, the optimal phase of the shift clock SCK is detected.

As described above, at whichever phase of the test pattern TPa the phase S starts, the region Z is detected by delaying the shift clock SCK by at least two clocks and the optimal phase of the shift clock SCK is detected.

Thus, by setting the clock phase adjustment period to two clocks or less, unnecessary adjustment working can be omitted, which can shorten time required for the clock phase adjustment period.

Figure 18:
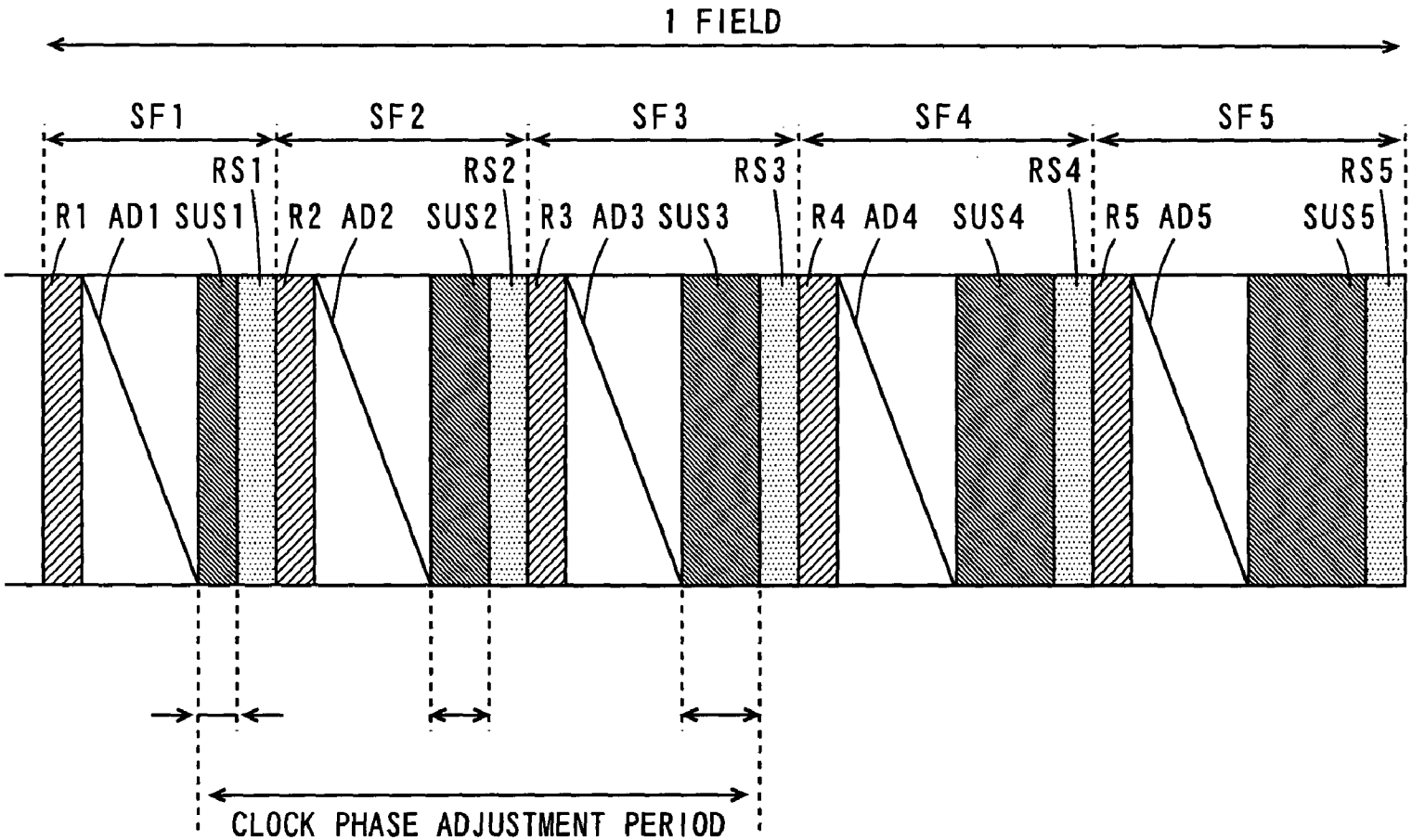
FIG. 18 is a diagram for explaining a case where a clock phase adjustment period is performed over a plurality of sustain periods.

FIG. 18 is a diagram for explaining a case where the clock phase adjustment period is performed over a plurality of sustain periods.

As shown in FIG. 18, the clock phase adjustment is performed from the beginning of the sustain period SUS1. As described in FIG. 3, if the clock phase adjustment has not finished within the sustain period SUS1, the clock phase adjustment is continued from the beginning of the sustain period SUS2 which is the next sustain period. In this case, the delay shift clock DSCK which has been stored in the phase data storing circuit 124 of FIG. 5 in advance is outputted in the optimal phase in the write period AD2 to latch the serial data SD.

Similarly, if the clock phase adjustment has not finished within the sustain period SUS2, either, the delay shift clock DSCK which has been stored in the phase data storing circuit 124 in advance is outputted in the optimal phase in the write period AD3 to latch the serial data SD.

If the clock phase adjustment period has finished within the sustain period SUS3, the optimal phase of the delay shift clock DSCK is stored in the phase data storing circuit 124 and from the next write period AD4, the serial data SD is latched in the optimal phase of the delay shift clock DSCK stored newly.

Figure 19:
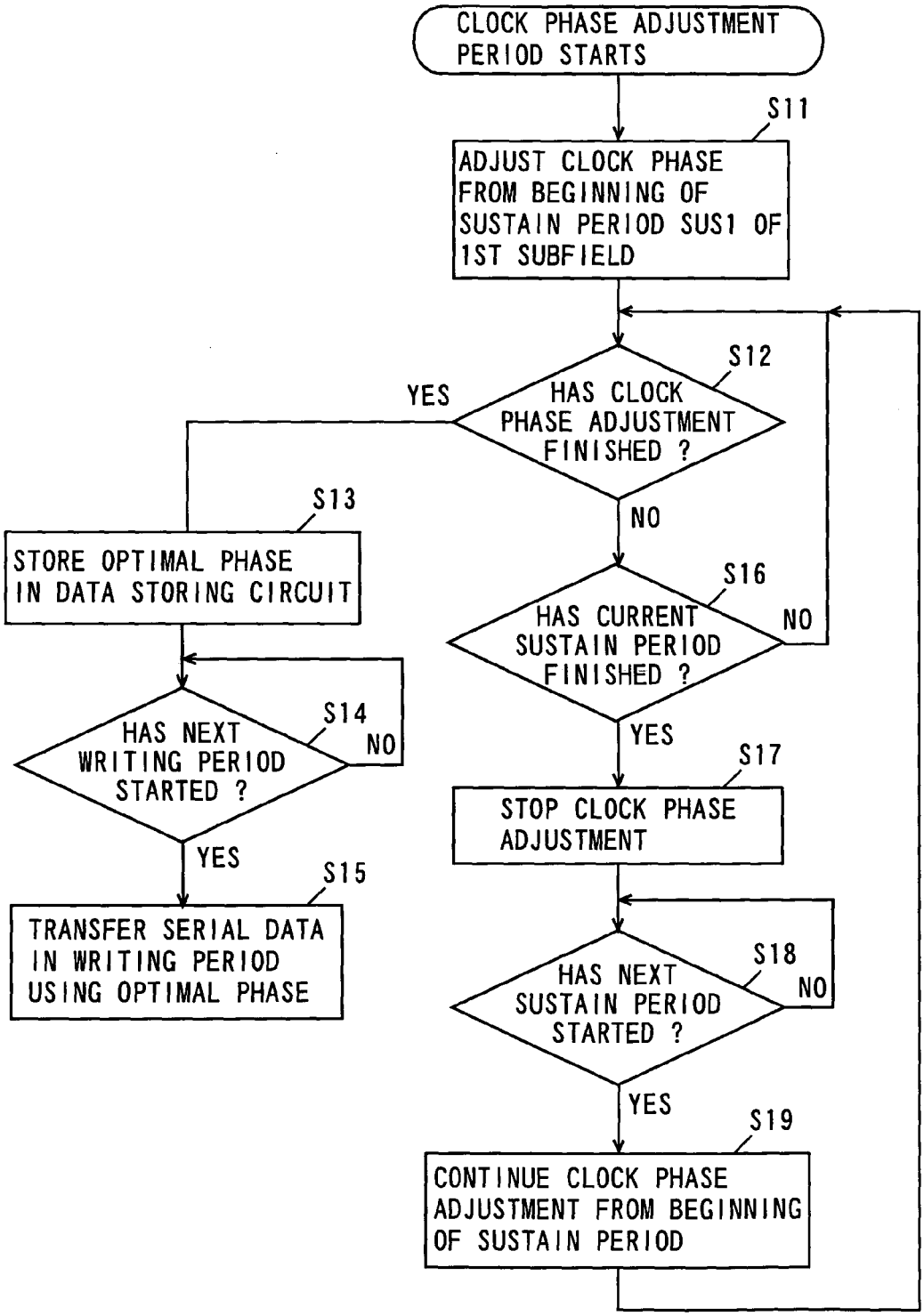
FIG. 19 is a flowchart showing one example of the operation of the phase controlling circuit in the clock phase adjustment period.

FIG. 19 is a flowchart showing one example of operation of the phase controlling circuit 123 in the clock phase adjustment period. Hereinafter, referring to FIG. 18, a description of the flowchart of FIG. 19 is given.

As shown in FIG. 19, when the clock phase adjustment period starts, the phase controlling circuit 123 performs the clock phase control from the beginning of the sustain period SUS1 of the first subfield (step S11). Next, the phase controlling circuit 123 determines whether or not the clock phase adjustment has finished (step S12). The phase controlling circuit 123, when it determines the clock phase adjustment has finished, stores the optimal phase in the data storing circuit 124 (step S13).

Next, the phase controlling circuit 123 determines whether or not the next write period has started (step S14). When the phase controlling circuit 123 determines the next write period has not started, it stands by and when it determines the next write period has started, the delay shift clock DSCK is outputted in the optimal phase to perform the transfer of the serial data SD (step S15).

In step S12, when the phase controlling circuit 123 determines the clock phase adjustment has not finished, it determines whether or not the current sustain period has finished (step S16).

When the phase controller circuit 123 determines the current sustain period has not finished, it repeats the operation from the step S12. In step S16, when the phase controlling circuit 123 determines the current sustain period has finished, it stops the clock phase adjustment (step S17).

Next, the phase controlling circuit 123 determines whether or not the next sustain period has started (step S18). When the phase controlling circuit 123 determines the next sustain period has not started, the circuit stands by. When the phase controlling circuit 123 determines the next sustain period has started in step S18, the circuit continues the clock phase adjustment from the beginning of the sustain period (step S19). Thereafter, the phase controlling circuit 123 repeats the operation from the step S12.

Figure 20:
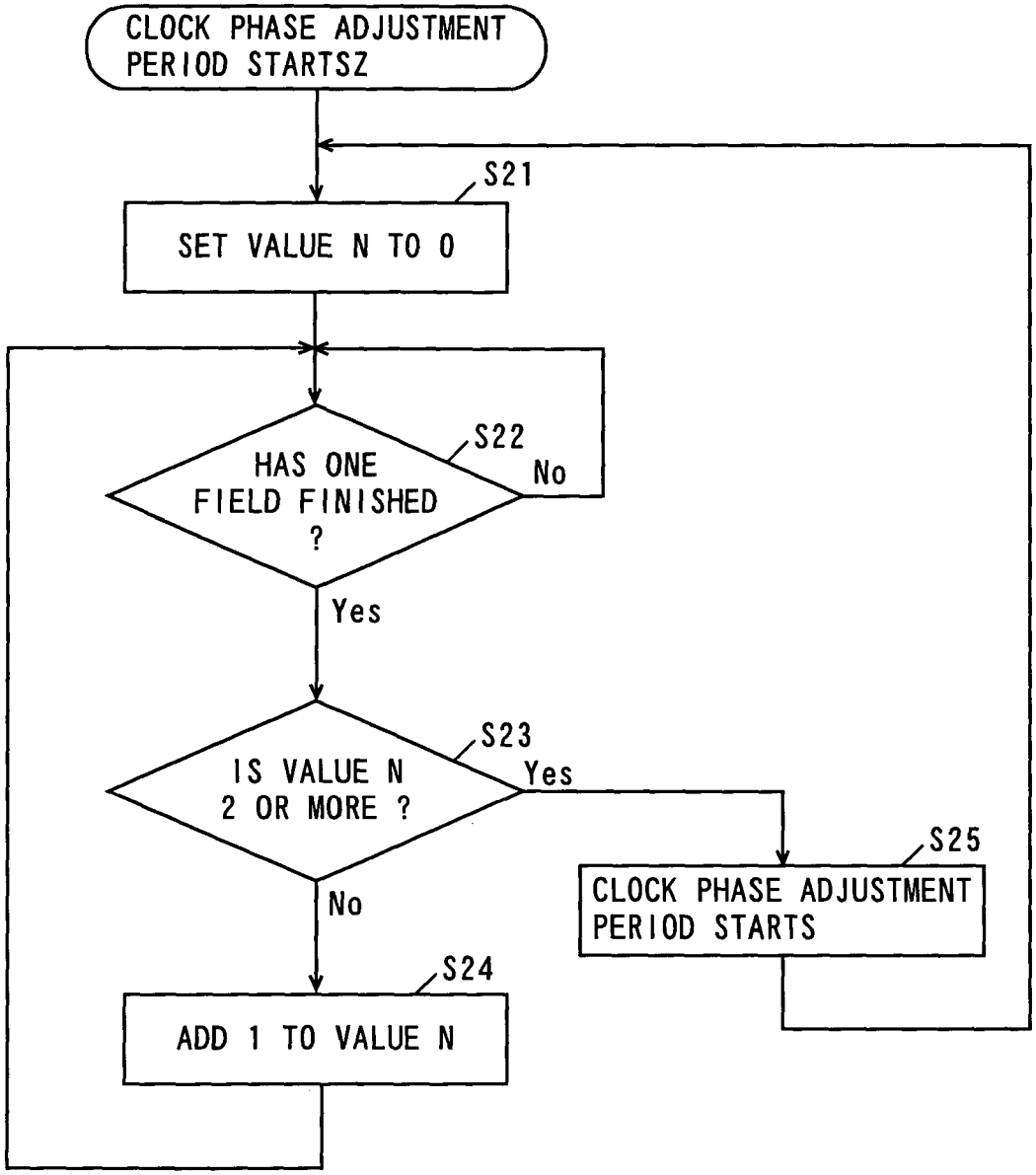
FIG. 20 is a flowchart showing one example of the operation of the phase controlling circuit for starting the clock phase adjustment every three fields.

FIG. 20 is a flowchart showing one example of operation of the phase controlling circuit 123 for starting the clock phase adjustment every three fields. Hereinafter, referring to FIG. 3, a description of the flowchart of FIG. 20 is given.

As shown in FIG. 20, the phase controlling circuit 123 sets a value N to 0 (step S21). Next, the phase controlling circuit 123 determines whether or not one field has finished (step S22).

When the phase controlling circuit 123 determines one field has not finished, the circuit stands by. When the phase controlling circuit 123 determines one field has finished in step S22, the circuit determines whether or not the value N is 2 or more (step S23). When the phase controlling circuit 123 determines the value N is neither 2 nor more, 1 is added to the value N (step S24).

In step S23, when the phase controlling circuit 123 determines the value N is 2 or more, the circuit starts the clock phase adjustment (step S25). Thereafter, the phase controlling circuit 123 repeats the operation from step S21.

Figure 21:
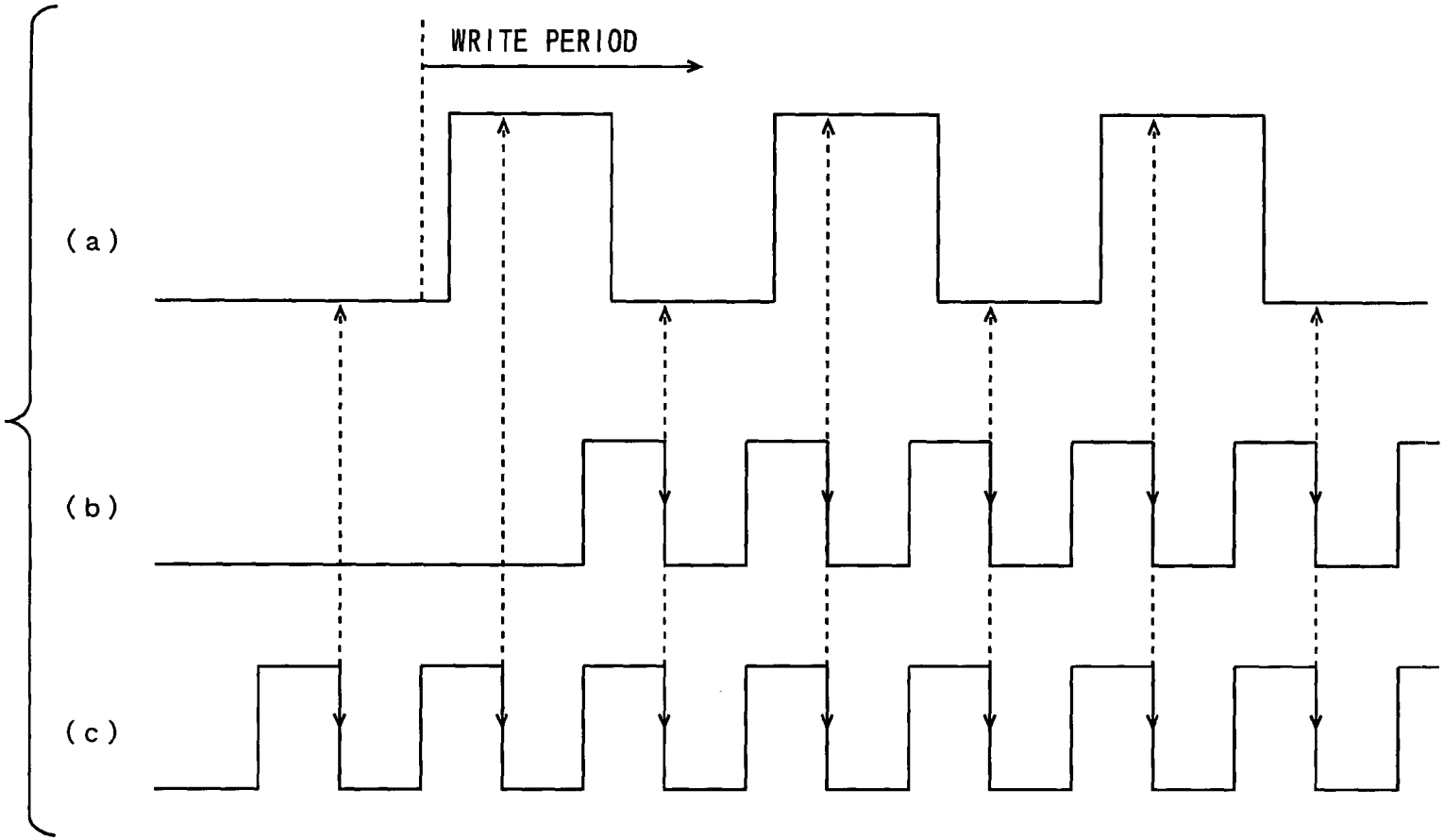
FIG. 21 is a diagram for explaining timing at which the delay shift clock is generated in the write period.

FIG. 21 is a diagram for explaining timing when the delay shift clock DSCK is generated in the write period.

FIG. 21(*a*) is a waveform diagram of the serial data SD, and FIGS. 21(*b*) and 21(*c*) are waveform diagrams of the delay shift clock DSCK.

As described in FIG. 18, when the clock phase adjustment period has finished, for the delay shift clock DSCK in the next write period, the optimal phase of the delay shift clock DSCK stored in the phase data storing circuit 124 of FIG. 5 is used.

When an alternating pulse of the shift clock SCK is generated in the middle of the write period as shown in FIG. 21(*b*), a part of the beginning of the serial data SD is not latched, and the part of the serial data SD is not transferred to the data driver 2 of FIG. 3.

In the plasma display device according to the present embodiment, just as the write period starts as shown in FIG. 21(*c*), the shift clock SCK is generated, and all the serial data SD is transferred to the data driver 2.

When the optimal phase of the delay shift clock DSCK is detected, the phase controlling circuit 123 controls the delay amount of the data delay circuit 160 by the phase delay signal DPC so that the phase of the start portion of the serial data SDa outputted to the data driver 2 and the phase of the delay shift clock DSCK outputted to the data driver 2 coincide with each other.

When it is detected that the phase of the delay shift clock DSCK has become the optimal phase, no latch failure occurs, and thus, the phase of the serial data SDa can be adjusted with a high accuracy.

The phase of the serial data SDa adjusted by the phase controlling circuit 123 is stored in the phase data storing circuit 129 as the optimal phase, and the phase controlling circuit 123 adjusts the phase of the serial data SDa to the optimal phase stored in the phase data storing circuit 129 in the write period after the optimal phase has been stored in the phase data storing circuit 129.

Thus, the serial data SDa with the optimal phase is transferred to the data driver 2 in synchronization with the delay shift clock DSCK with the optimal phase. Accordingly, the serial data SDa can be stably transferred to the data driver 2.

When the optimal phase of the delay shift clock DSCK or the optimal phase of the serial data SDa is not detected, the phase controlling circuit 123 adjusts the phase of the delay shift clock DSCK to the optimal phase stored in the phase data storing circuit 124 last time and at the same time, adjusts the phase of the serial data SDa to the optimal phase stored in the phase data storing circuit 129 last time.

In this case, even if the optimal phase of the delay shift clock DSCK or the optimal phase of the serial data SDa is not detected due to noise or the like, stable writing operation of the serial data SDa to the data driver 2 is ensured.

As described above, all the required serial data SD can be transferred to the data driver 2.

Although in the plasma display device according to the present embodiment, the test pattern is latched at the fall of the delay shift clock DSCK, the test pattern may be latched at the rise of the delay shift clock DSCK.

Furthermore, although in the plasma display device according to the present embodiment, the serial data SD is inputted into the test pattern generating circuit 100, the serial data SD may be provided to the data delay circuit 160 without going through the test pattern generating circuit 100.

In the plasma display device according to the present embodiment, the shift clock SCK corresponds to a clock signal, the shift clock generating circuit 10 corresponds to a clock signal generator, the subfield converter 8 corresponds to a serial data generator, the test pattern generating circuit 100 corresponds to a test signal generator, the flip-flop circuit 110 corresponds to a latch device and a latch circuit, the latch failure detecting circuit 130 corresponds to a latch failure detector and a latch failure detecting circuit, the clock phase controlling circuit 120 or the phase controlling circuit 123 and the clock delay circuit 140 corresponds to a phase adjustment device, the phase data storing circuit 124 corresponds to a first storage device, the phase sustain periods SUS1 to SUS5 correspond to adjustment periods, the RS flip-flop circuit 137 corresponds to a holding circuit, the clock delay circuit 140 corresponds to a ring buffer, the delay circuit 139 corresponds to a reset signal generating circuit or a delay circuit, the output circuit 143 corresponds to a selector, the delay circuits BF(1) to BF(t) correspond to delay circuits, the output circuit 144 corresponds to a connection circuit, and the phase data storing circuit 129 corresponds to a second storage device.

Second Embodiment

Figure 22:
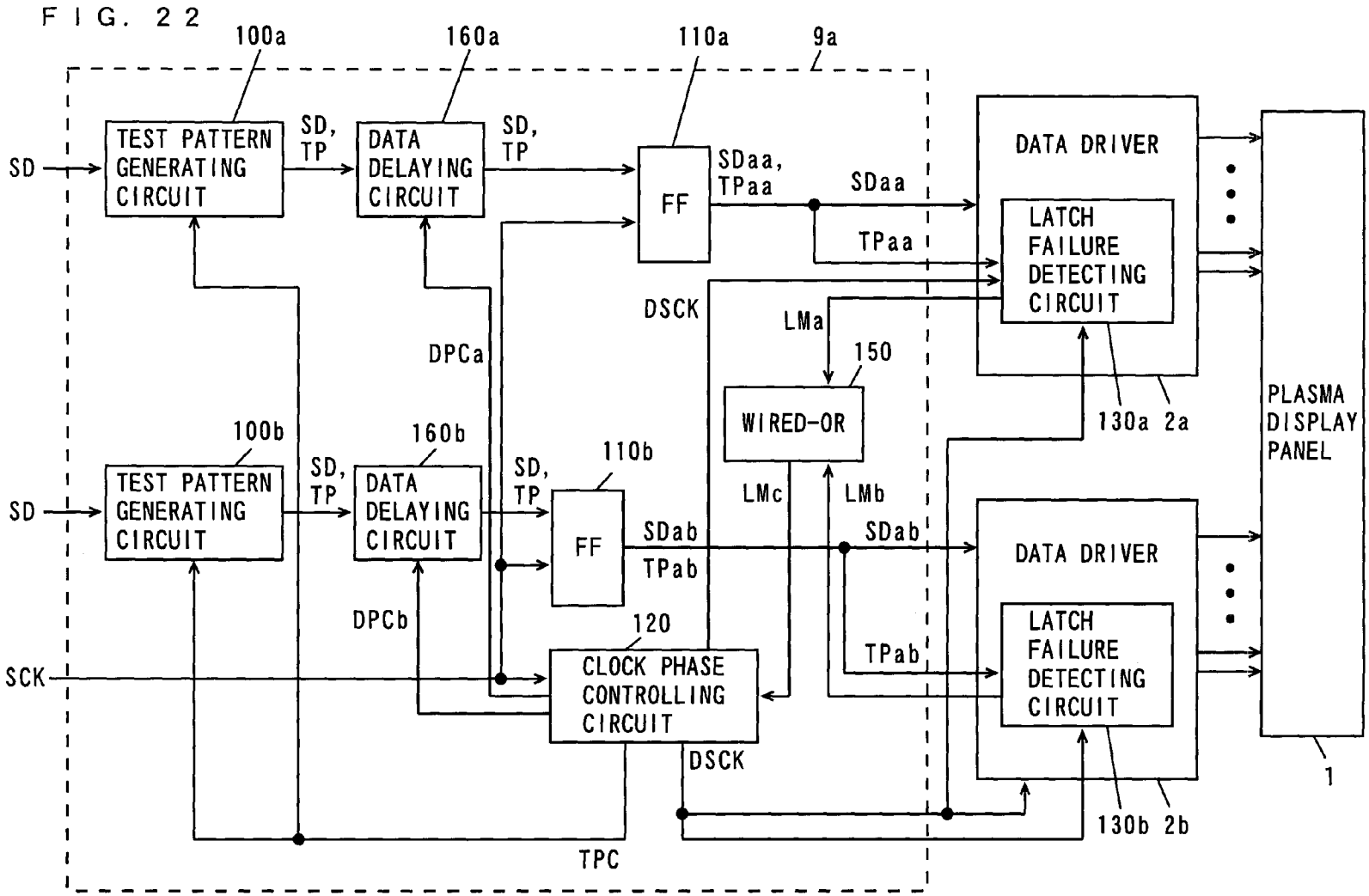
FIG. 22 is a block diagram showing an internal configuration of a clock phase adjuster according to a second embodiment.

FIG. 22 is a block diagram showing an internal configuration of a clock phase adjuster 9*a* according to a second embodiment.

In the present embodiment, two data drivers 2*a*, 2*b* are connected to the PDP1.

A different point of the clock phase adjuster 9*a* from the clock phase adjuster 9 of FIG. 4 is that it includes two sets of test pattern generating circuits 100*a*, 100*b*, data delay circuits 160*a*, 160*b* and flip-flop circuits 110*a*, 110*b* for the two data drivers 2*a*, 2*b*, and includes a common clock phase controlling circuit 120 and a wired-OR circuit 150.

Furthermore, the two data drivers 2*a*, 2*b* include latch failure detecting circuits 130*a*, 130*b*, respectively.

The serial data SD outputted by the subfield converter 8 of FIG. 1 and the test pattern control signal TPC outputted by the clock phase controller 120 are provided to the test pattern generating circuits 100*a*, 100*b*.

The test pattern generating circuits 100*a*, 100*b* each output the serial data SD provided from the subfield converter 8 without modification in the write periods AD1 to AD5 described in FIG. 2. Furthermore, the test pattern generating circuits 100*a*, 100*b* each output the test pattern TP according to the test pattern control signal TPC in the clock phase adjustment period described in FIG. 3.

The serial data SD or the test pattern TP outputted by the test pattern generating circuit 100*a* is provided to the data delay circuit 160*a*, respectively. The data delay circuit 160*a* outputs the test pattern TP without modification, and delays and outputs the serial data SD based on a phase delay signal DPCa provided from the clock phase controller 120.

The serial data SD or the test pattern TP outputted by the test pattern generating circuit 100*b* is provided to the data delay circuit 160*b*, respectively. The data delay circuit 160*b* outputs the test pattern TP without modification, and delays and outputs the serial data SD based on a phase delay signal DPCb provided from the clock phase controller 120.

The serial data SD or the test pattern TP outputted by the data delay circuits 160*a*, 160*b* and the shift clock SCK are provided to the flip-flop circuits 110*a*, 110*b*.

The flip-flop circuit 110*a* latches the serial data SD or the test pattern TP at the fall of the shift clock SCK and outputs the same as serial data SDaa or a test pattern TPaa.

The flip-flop circuit 110*b* latches the serial data SD or the test pattern TP at the fall of the shift clock SCK and outputs the same as serial data SDab or a test pattern TPab.

The test pattern TPaa outputted by the flip-flop circuit 110*a* and the delay shift clock DSCK outputted by the clock phase controller 120 are provided to the latch failure detecting circuit 130*a*. The latch failure detecting circuit 130*a* latches the test pattern TPaa at the fall of the delay shift clock DSCK to output a latch failure detection signal LMa indicating the presence/absence of latch failure occurrence.

The test pattern TPab outputted by the flip-flop circuit 110*b* and the delay shift clock DSCK outputted by the clock phase controller 120 are provided to the latch failure detecting circuit 130*b*. The latch failure detecting circuit 130*b* latches the test pattern TPab at the fall of the delay shift clock DSCK to output a latch failure detection signal LMb indicating the presence/absence of latch failure occurrence.

The latch failure detecting circuits 130*a*, 130*b* each have an open drain output. The latch failure detection signal LMa outputted by the latch failure detection circuit 130*a* and the latch failure detection signal LMb outputted by the latch failure detection circuit 130*b* are provided to the wired-OR circuit 150.

The wired-OR circuit 150 outputs an AND of the latch failure detection signals LMa, LMb as a latch failure detection signal LMc, and provides the same to the clock phase controller 120. Accordingly, if either of the latch failure detection signals LMa, LMb has a low portion, a low portion also occurs in the latch failure detection signal LMc.

The clock phase controller 120 detects the optimal phase of the delay shift clock DSCK based on the latch failure detection signal LMc and outputs the delay shift clock DSCK in the clock phase adjustment period.

Furthermore, the clock phase controller 120 detects optimal phases of the serial data SDaa, SDab after the clock phase adjustment period and provides phase delay signals DPCa, DPCb to the data delay circuits 160*a*, 160*b*, respectively.

The serial data SDaa, SDab outputted by the flip-flop circuits 110*a*, 110*b* and the delay shift clock DSCK outputted by the clock phase controller 120 are provided to the data drivers 2*a*, 2*b*.

As described above, in the clock phase adjuster 9*a* according to the present embodiment, the AND of the plurality of latch failure detection signals LMa, LMb are outputted by the wired-OR circuit 150 as the latch failure detection signal LMc. Further, the phase adjustment of the shift clock SCK is possible by the one clock phase controlling circuit 120 for the plurality of data drivers. Accordingly, the circuit configuration can be simplified.

Although in the clock phase adjuster 9*a* according to the present embodiment, the test pattern generating circuits 100*a*, 100*b* are provided to the drivers 2*a*, 2*b*, respectively, a common test pattern circuit may be provided. In this case, the common test pattern circuit selectively generates the test pattern TP for one of the data drivers 2*a*, 2*b* which is an object of the latch failure detection. This simplifies the circuit configuration of the clock phase adjuster 9*a*.

Furthermore, although in the clock phase adjuster 9*a* according to the present embodiment, the number of the data drivers is 2, it may be 3 or more.

In the plasma display device according to the present embodiment, the test pattern generating circuits 100*a*, 100*b* correspond to test signal generators, the flip-flop circuits 110*a*, 110*b* correspond to latch devices and latch circuits, and the latch failure detecting circuits 130*a*, 130*b* correspond to latch failure detectors.

The invention claimed is:

1. A plasma display driven by a subfield system including a plurality of subfields into which each field is temporally divided, each of said plurality of subfields including a write period and a sustain period subsequent to said write period, said plasma display comprising:

a plurality of data electrodes arranged in a vertical direction;

a plurality of scan electrodes arranged in a horizontal direction;

a plurality of sustain electrodes arranged in a horizontal direction so as to correspond to said plurality of scan electrodes, respectively;

a plurality of discharge cells provided at intersections of said plurality of data electrodes, said plurality of scan electrodes and said plurality of sustain electrodes;

a clock signal generator that generates a clock signal;

a serial data generator that generates serial data according to an image to be displayed;

a test signal generator that generates a test signal;

a data driver that selectively applies a drive pulse to said plurality of data electrodes based on the serial data generated by said serial data generator in synchronization with said clock signal in a write period of each subfield, to cause a selected discharge cell to generate an address discharge;

a driver that sequentially applies a drive pulse to said plurality of scan electrodes in said write period and alternately applies a sustain pulse to said plurality of scan electrodes and said plurality of sustain electrodes in said sustain period subsequent to said write period, to cause said selected discharge cell to generate a sustain discharge for display of an image;

a latch failure detector that includes a latcher that latches the test signal generated by said test signal generator to detect a presence/absence of a latch failure in said data driver based on an output signal from said latcher in an adjustment period formed of a sustain period of one or a plurality of subfields;

a phase adjuster that, when the latch failure is detected by said latch failure detector, adjusts a phase of the clock signal provided from said clock signal generator to said data driver, based on the phase of the clock signal in which the latch failure is detected; and a first storage device that stores the phase of the clock signal adjusted by said phase adjuster as an optimal phase, wherein said phase adjuster varies the phase of said clock signal to detect a phase range where no latch failure occurs, and stores, in said first storage device, a phase in a center of said detected phase range as said optimal phase during said adjustment period, and adjusts the phase of said clock signal to said optimal phase stored in said first storage device in the write period after said optimal phase is stored by said first storage device, and wherein said data driver includes a plurality of data drivers;

said latch failure detector includes a plurality of latch failure detectors that detect the presence/absence of the latch failure by respective data drivers based on the test signal output from said test signal generator; and when the latch failure is detected in at least one of said plurality of latch failure detectors, said phase adjuster adjusts the phase of the clock signal provided to said plurality of data drivers from said clock signal generator.

2. The plasma display according to claim 1, wherein said plurality of latch failure detectors each have an open drain output; and said phase adjuster receives the open drain outputs of said plurality of latch failure detectors via a wired-OR connection.

3. The plasma display according to claim 1, wherein said test signal is an alternating pulse signal that is inverted every period of said clock signal.

4. The plasma display according to claim 3, wherein said latch failure detector generates a latch failure detection signal indicating the presence/absence of the latch failure, based on an exclusive logical sum of a first test signal obtained by delaying said test signal by one period of said clock signal and a second test signal obtained by delaying said test signal by two periods of said clock signal.

5. The plasma display according to claim 4, wherein said latch failure detector generates a plurality of latch failure detection signals obtained by sequentially delaying said latch failure detection signal by a predetermined delay amount to generate a logical product of said plurality of latch failure detection signals.

6. The plasma display according to claim 1, wherein said phase adjuster adjusts the phase of the clock signal at predetermined intervals.

7. The plasma display according to claim 1, wherein said phase adjuster adjusts the phase of the clock signal at intervals of a plurality of fields.

8. The plasma display according to claim 1, wherein said phase adjustment includes a plurality of phase adjustment periods; and said phase adjuster continues, when the adjustment of said phase of the clock signal has not finished in one adjustment period, the phase adjustment of said phase of the clock signal from the beginning of the next adjustment period.

9. The plasma display according to claim 1, wherein said latch failure detector includes a holder that holds a detection result of the latch failure until a reset signal is inputted.

10. The plasma display according to claim 9, wherein said latch failure detector further includes a reset signal generator that generates said reset signal based on the detection result of the latch failure.

11. The plasma display according to claim 1, wherein the phase adjuster is operable to detect that the phase of the adjusted clock signal is an optimal phase and to finish the adjustment of the phase of said clock signal when it is detected that the phase of the clock signal is the optimal phase.

12. The plasma display according to claim 1, wherein said phase adjuster adjusts the phase of said clock signal to a phase stored in advance in said first storage device when the adjustment of said phase of the clock signal has not finished in said adjustment period.

13. The plasma display according to claim 1, wherein said phase adjuster, stores, in said first storage device, the phase in the center of said detected phase range as said optimal phase when the detected range is larger than a predetermined threshold.

14. The plasma display according to claim 1, wherein said phase adjuster adjusts a relative phase of the clock signal with respect to said serial data so that said adjusted phase of the clock signal is output to the data driver just as a phase of a start portion of said serial data is output to said data driver.

15. The plasma display according to claim 14, wherein, said phase adjuster adjusts the phase of said serial data so that the phase of a start portion of the serial data output to said data driver and a phase of a start portion of the clock signal output to said data driver substantially coincide with each other when it is detected that the phase of said clock signal is the optimal phase.

16. The plasma display according to claim 15, further comprising a second storage device that stores the phase of said serial data adjusted by said phase adjuster as an optimal phase, wherein said phase adjuster adjusts the phase of said serial data to said optimal phase stored in said second storage device in the write period after said optimal phase is detected by said second storage device.

17. The plasma display according to claim 16, wherein said phase adjuster adjusts the phase of said clock signal to the optimal phase stored in said first storage device a last time and adjusts the phase of said serial data to the optimal phase stored in said second storage device a last time when the optimal phase of said clock signal or the optimal phase of said serial data is not detected.

18. A plasma display driven by a subfield system including a plurality of subfields into which each field is temporally divided, each of said plurality of subfields including a write period and a sustain period subsequent to said write period, said plasma display comprising:

a plurality of data electrodes arranged in a vertical direction;

a plurality of scan electrodes arranged in a horizontal direction;

a plurality of sustain electrodes arranged in a horizontal direction so as to correspond to said plurality of scan electrodes, respectively;

a plurality of discharge cells provided at intersections of said plurality of data electrodes, said plurality of scan electrodes and said plurality of sustain electrodes;

a clock signal generator that generates a clock signal;

a serial data generator that generates serial data according to an image to be displayed;

a test signal generator that generates a test signal;

a data driver that selectively applies a drive pulse to said plurality of data electrodes based on the serial data generated by said serial data generator in synchronization with said clock signal in a write period of each subfield, to cause a selected discharge cell to generate an address discharge;

a driver that sequentially applies a drive pulse to said plurality of scan electrodes in said write period and alternately applies a sustain pulse to said plurality of scan electrodes and said plurality of sustain electrodes in said sustain period subsequent to said write period, to cause said selected discharge cell to generate a sustain discharge for display of an image;

a latch failure detector that includes a latcher that latches the test signal generated by said test signal generator to detect a presence/absence of a latch failure in said data driver based on an output signal from said latcher in an adjustment period formed of a sustain period of one or a plurality of subfields;

a phase adjuster that, when the latch failure is detected by said latch failure detector, adjusts a phase of the clock signal provided from said clock signal generator to said data driver, based on the phase of the clock signal in which the latch failure is detected; and a first storage device that stores the phase of the clock signal adjusted by said phase adjuster as an optimal phase, wherein said phase adjuster varies the phase of said clock signal to detect a phase range where no latch failure occurs, and stores, in said first storage device, a phase in a center of said detected phase range as said optimal phase during said adjustment period, and adjusts the phase of said clock signal to said optimal phase stored in said first storage device in the write period after said optimal phase is stored by said first storage device, and wherein said phase adjuster includes:

a ring buffer including a plurality of delay elements that sequentially delay said clock signal by a predetermined delay amount; and a selector that selectively outputs a plurality of clock signals output from said plurality of delay elements of said ring buffer.

19. A plasma display driven by a subfield system including a plurality of subfields into which each field is temporally divided, each of said plurality of subfields including a write period and a sustain period subsequent to said write period, said plasma display comprising:

a plurality of data electrodes arranged in a vertical direction;

a plurality of scan electrodes arranged in a horizontal direction;

a plurality of sustain electrodes arranged in a horizontal direction so as to correspond to said plurality of scan electrodes, respectively;

a plurality of discharge cells provided at intersections of said plurality of data electrodes, said plurality of scan electrodes and said plurality of sustain electrodes;

a clock signal generator that generates a clock signal;

a serial data generator that generates serial data according to an image to be displayed;

a test signal generator that generates a test signal;

a data driver that selectively applies a drive pulse to said plurality of data electrodes based on the serial data generated by said serial data generator in synchronization with said clock signal in a write period of each subfield, to cause a selected discharge cell to generate an address discharge;

a driver that sequentially applies a drive pulse to said plurality of scan electrodes in said write period and alternately applies a sustain pulse to said plurality of scan electrodes and said plurality of sustain electrodes in said sustain period subsequent to said write period, to cause said selected discharge cell to generate a sustain discharge for display of an image;

a latch failure detector that includes a latcher that latches the test signal generated by said test signal generator to detect a presence/absence of a latch failure in said data driver based on an output signal from said latcher in an adjustment period formed of a sustain period of one or a plurality of subfields;

a phase adjuster that, when the latch failure is detected by said latch failure detector, adjusts a phase of the clock signal provided from said clock signal generator to said data driver, based on the phase of the clock signal in which the latch failure is detected; and a first storage device that stores the phase of the clock signal adjusted by said phase adjuster as an optimal phase, wherein said phase adjuster varies the phase of said clock signal to detect a phase range where no latch failure occurs, and stores, in said first storage device, a phase in a center of said detected phase range as said optimal phase during said adjustment period, and adjusts the phase of said clock signal to said optimal phase stored in said first storage device in the write period after said optimal phase is stored by said first storage device, and wherein said phase adjuster includes:

a plurality of delays each having a different number of delay amounts; and a connector that selects one or more of said plurality of delays so as to constitute a series-connector by the selected one or more of said plurality of delays and provides said clock signal to said series-connector.

* * * * *